US005598641A

United States Patent [19]

Kishi

[11] Patent Number: 5,598,641

[45] Date of Patent: Feb. 4, 1997

[54] RAW SEWAGE DISPOSAL APPARATUS

[75] Inventor: Mitsuhiro Kishi, Ashikaga, Japan

[73] Assignee: Nikken Corporation, Tokyo, Japan

[21] Appl. No.: 515,979

[22] Filed: Aug. 16, 1995

[30] Foreign Application Priority Data

Aug. 22, 1994 [JP] Japan ..... 6-219457

[51] Int. Cl.[6] ..... F26B 3/34

[52] U.S. Cl. ..... 34/247; 34/255; 34/60; 34/95; 110/238; 4/111.1

[58] Field of Search ..... 34/255, 60, 95, 34/247; 219/707, 679, 681, 635; 110/238; 4/111.1, 111.2, 111.3, 111.4, 111.5, 111.6, 449

[56] References Cited

U.S. PATENT DOCUMENTS

| | | | |
|---|---|---|---|
| 4,173,925 | 11/1979 | Leon | 99/348 |
| 4,999,930 | 3/1991 | Kishi et al. | 34/95 |
| 5,058,213 | 10/1991 | Kishi et al. | 4/111.1 |
| 5,152,074 | 10/1992 | Kishi | 34/247 |
| 5,230,164 | 7/1993 | Kishi | 34/60 |
| 5,257,466 | 11/1993 | Kishi | 34/95 |
| 5,261,126 | 11/1993 | Kishi | 4/111.5 |
| 5,418,982 | 5/1995 | Kishi | 4/111.1 |

OTHER PUBLICATIONS 10 sheets of drawings from U.S. Serial No. 08/342 415, filed on Nov. 18, 1994.

*Primary Examiner*—John M. Sollecito
*Assistant Examiner*—Steve Gravini
*Attorney, Agent, or Firm*—Flynn, Thiel, Boutell & Tanis, P.C.

[57] ABSTRACT

A raw sewage disposal apparatus for evaporating and drying raw sewage by heating. An evaporation container has a closed bottom portion and an opened upper portion for containing raw sewage thereon. A rotary holding structure holds an upper end of the evaporation container so as to permit horizontal rotation thereof. A covering supports the rotary holding structure and closes the opened upper portion of the evaporation container from the atmosphere. A frame capable of hanging the evaporation container supports the covering substantially horizontally. A driving device is provided for rotating the evaporation container, and an electromagnetic heating means is disposed close to a lower surface of the evaporation container and generates a high-frequency electromagnetic wave which is supplied to the evaporation container.

16 Claims, 27 Drawing Sheets

FIG. 18

| | PREHEATING | STANDBY | INTRODUCTION OF RAW SEWAGE | DURING DRY PROCESSING | CLEANING OF DRYING CAULDRON |
|---|---|---|---|---|---|
| AIR BLOWER 135 | ON<br>HIGH SPEED | ON<br>LOW SPEED | ON<br>LOW SPEED | ON<br>HIGH SPEED | ON<br>HIGH SPEED |
| MOTOR 60 | OFF | OFF | ON (INVERSION) | ON (INVERSION) | ON (INVERSION) |
| HEATER 142 | ON | ON | ON | ON | OFF |
| HIGH-FREQUENCY COIL 98 | OFF | OFF | OFF | ON | OFF |
| RAW SEWAGE INTRODUCTION VALVE 81 | CLOSE | CLOSE | OPEN | CLOSE | CLOSE |
| SELECTOR VALVE 138 | C SIDE | C SIDE | C SIDE | C SIDE | B SIDE |
| CLOSING VALVE 140 | OPEN | OPEN | OPEN | OPEN | CLOSE |
| CLOSING VALVE 144 | CLOSE | CLOSE | CLOSE | OPEN | CLOSE |
| CLOSING VALVE 148 | CLOSE | CLOSE | CLOSE | OPEN | OPEN |
| CLOSING VALVE 151 | CLOSE | CLOSE | CLOSE | CLOSE | OPEN |

RAW SEWAGE DISPOSAL APPARATUS

FIELD OF THE INVENTION

The present invention relates to a raw sewage disposal apparatus, and more particularly to such an apparatus including a simple mechanism for hanging and rotatably supporting an evaporation container.

BACKGROUND OF THE INVENTION

The raw sewage discharged from humans is typically discharged into a sewage system by a flush toilet or the like and then flows into a river after purification in a holding tank. However, at events such as festivals, athletic events, fairs, meetings and the like, temporary toilet facilities must be provided for disposal of raw human waste.

Employed conventionally are movable temporary toilets, most of which have a tank for temporarily containing the raw sewage therein. However, temporary toilets require the raw sewage contained in the tank be sucked into a vacuum truck, and the collected raw sewage must then be transferred to a sewage purifying facility. This is laborious and time consuming and is unhygienic.

Transportation vehicles such as trains and buses, which operate over long distance, are provided with a tank exclusively for storing the discharged raw sewage. The raw sewage in this tank is subjected to a chemical deodorizing treatment and is thereafter collected by a vacuum truck at a terminal or collection point.

The storing, collecting and disposal methods are thus not modern and are very unhygienic. If the temporary toilet has been used for a long period of time, the raw sewage in the tank causes a bad smell, and operators dislike disposing of the raw sewage.

In an attempt to ameliorate the above problem, there have been proposed several hygienic disposal methods. In one method, chemicals are introduced into the raw sewage storage tank to prevent the generation of the bad smell and to effect sterilization of the sewage. This method, however, cannot be used for a long period of time because the chemicals become diluted, water flows in a stool is polluted with raw sewage, and costs are high, though this method is often employed in transportation vehicles.

In another method, the raw sewage is contained in a bag made of vinyl or the like to prevent the diffusion of the bad smell. This method, however, requires a vinyl bag of large size and involves a high cost for disposal thereof, and it is troublesome to separate the raw sewage from the bag. A large-scale disposal facility is also required.

In view of the drawbacks of the conventional method of disposing of raw sewage as discussed above, the present inventor proposed a disposing apparatus having the drying cauldron provided with stirring blades and heat-holding balls therein in which the raw sewage is stirred by the rotation of the stirring blades and heated by heat released by the heat-holding balls whereby the raw sewage is dried in a short period of time and the liquid component is evaporated. Arrangements of this general type are disclosed in Japanese Patent Nos. 63-124150 and 2-411577, as well as U.S. Pat. Nos. 4,999,930, 5,058,213, 5,152,074, 5,230,164, 5,257,466, 5,261,126 and 5,418,982.

According to my proposed disposal methods, the raw sewage is heated, evaporated in the drying cauldron and diffused into the ambient atmosphere. Before the liquid component is diffused, the components which cause bad smell are resolved by a catalyst so that the liquid water is diffused into the atmosphere as an odorless vapor. It is preferable to employ such methods in view of environmental hygiene and preservation even if such methods are employed in crowded buildings and/or by throngs of people.

It is very hygienic to evaporate and diffuse the raw sewage contained in the airtight drying cauldron and such operations can be carried out systematically, which results in not causing a burden to the operators. It is necessary to stir the raw sewage which is contained in the airtight drying cauldron so as to heat and evaporate the raw sewage uniformly and residual substances which are not evaporated must be removed.

In the arrangement provided with a stirring blade, it is necessary to provide a rotary shaft which extends perpendicular relative to the drying cauldron, which entails increasing the height of the apparatus as a whole and which makes the mechanism very large. There is a case that foreign matter which cannot be evaporated, such as a metallic ball-point pen, a belt, clothing, etc. are introduced into the drying cauldron. In such a case, when the raw sewage is stirred the foreign matter enters a gap between the stirring blade and the drying cauldron, which prevents the stirring blade from rotating, and hence causes trouble. Since the rotary shaft and the stirring blade must be accommodated inside the drying cauldron, the limited inner space of the drying cauldron is occupied by these mechanisms. As a result, the inner space of the drying cauldron cannot be effectively utilized, which leads to inconveniences.

In an attempt to at least minimize these latter inconveniences, the inventor has made further improvement in such arrangement by eliminating the stirring blades, such modified arrangement being disclosed in Japanese Patent Application Serial No. 314445/93, and corresponding U.S. application Ser. No. 08/342 415. While this modification does represent an improvement, nevertheless there is still a desire to simplify the overall structure of the drying arrangement, and specifically the structure and mechanism for rotatably supporting the drying cauldron.

With this objection in mind, the present invention provides a raw sewage disposal apparatus having a drying arrangement which includes a cauldron into which the raw sewage is disposed and is subjected to heating, stirring and evaporation. The drying cauldron is horizontally rotatably supported by a simple mechanism which cooperates between the open upper end of the cauldron and a supporting frame so as to provide both a simple structure and a simplified operation. The advantageous arrangement of the present invention is explained in greater detail hereinafter.

SUMMARY OF THE INVENTION

A first aspect of the invention is a raw sewage disposal apparatus comprising a heat resistant metallic evaporation container having a closed bottom portion and an opened upper portion for containing raw sewage therein, a rotary holding means for holding an upper end of the evaporation container so as to horizontally rotatably hold the rotary holding means, a covering means for holding the rotary holding means between the evaporation container and a lower surface thereof, and for closing the opened upper portion of the evaporation container, a frame capable of hanging the evaporation container while supporting the covering means substantially horizontally, a driving means for rotating the evaporation container, and an electromagnetic heating means disposed adjacent to a lower surface of the evaporation container for generating a high-frequency electromagnetic wave therein and supplying the high-frequency electromagnetic wave to the evaporation container.

According to the first aspect of the invention, the evaporation container accommodating the raw sewage is supported by the rotary holding means at the upper opening thereof and the rotary holding means is fixed to the covering plate. As a result, the evaporation container is rotatably held in the state where the evaporation container is hung by the lower surface of the covering plate, which dispenses with a mechanism for restricting the evaporation container from the left and right and from the lower surface thereof to hold the evaporation container. Accordingly, the mechanism for holding the evaporation container is simplified and easily assembled and disassembled.

The electromagnetic heating means is provided at the portion close to the lower surface of the hung evaporation container for generating a high-frequency electromagnetic wave therein and supplying the high-frequency electromagnetic wave to the evaporation container so that the evaporation container is heated by induction heating owing to the electromagnetic wave. When the electromagnetic wave is generated, heat is not generated at the portion other than the metallic portion but heat is generated at the metallic portion alone, for thereby improving thermal efficiency.

Since the evaporation container is rotated to stir the raw sewage, even if foreign matters other than the raw sewage is introduced into the evaporation container, they do not bite into the stirring blades, which reduces wear of the stirring blades.

Further, since the stirring means contact a movement restriction portion and rotate on the bottom portion of the evaporation container, the raw sewage is mixed, thereby increasing temperature of the mixed raw sewage. As a result, evaporation of the raw sewage is expedited.

A second aspect of the invention is a raw sewage disposal apparatus comprising at least one stirring means contained in the evaporation container and having a spherical shape and a movement restriction portion having an upper end fixed to a lower surface of the covering means, and a lower end extended to the bottom portion of the evaporation container so as to contact the stirring means in addition to the elements of the first aspect of the invention.

According to the second aspect of the invention, the evaporation container is rotatably hung by the lower surface of the covering plate by way of the rotary holding means, and the spherical stirring means are contained in the evaporation container, and the movement restriction portion is inserted from the covering plate into the evaporation container. Since the stirring means are rotated while they contact the movement restriction portion, the raw sewage is mixed in the evaporation container so that temperature of the raw sewage is uniformly increased to expedite the evaporation of the raw sewage. Since the movement restriction portion for contacting the stirring means is alone, a plurality of stirring means are not concentrated or gathered at the specific portion of the evaporation container, which ensures the mixing of the raw sewage. Since the raw sewage is stuck to the surface of the stirring means so that upper portions of the raw sewage can contact the air when the stirring means are rotated in the evaporation container, surface areas of the raw sewage are increased, which expedites evaporating speed of the raw sewage.

A third aspect of the invention is a raw sewage disposal apparatus comprising a dust suction portion disposed vertically inside the evaporation container, the dust suction portion having an upper end fixed to a lower surface of the covering means and a lower end positioned adjacent to the bottom portion of the evaporation container for sucking air so as to suck dust in the evaporation container.

According to the third aspect of the invention, since air can be sucked by the dust suction means from the portion adjacent to the bottom portion of the evaporation container, it is possible to suck the dust remaining on the evaporation container together with the air after drying of the raw sewage and also to clean after drying process. Accordingly, the dust does not remain in the evaporation container, and hence the raw sewage disposal apparatus can be used continuously for a long time.

And, since the stirring means are rotated while contacting the movement restriction portion, it is possible to remove the dust remaining in the evaporation container by the stirring means, and also to crush the dust to pieces, so that the evaporation container can be cleaned. The crushed dust with the air can be discharged toward the atmosphere, thereby improving the cleaning efficiency.

A fourth aspect of the invention is a raw sewage disposal apparatus comprising a dust separation portion connected to a discharge side of the dust suction portion for separating the dust from the air and an air blower portion having a suction side connected to a discharge side of the dust separation portion in addition to the elements of the fourth aspect of the invention.

According to the fourth aspect of the invention, after the raw sewage is subjected to the drying process, the dust remaining in the evaporation container can flow to the outside together with the air. In the dust mixed with the air, only the dust can be separated from the air and the air alone can flow toward the suction side of the air blower by the dust separation portion disposed outside the evaporation container. As a result, the dust is not diffused outside, and-the separation and collection of the dust becomes easy.

A fifth aspect of the invention is a raw sewage disposal apparatus comprising a stool disposed above the covering means for communicating with an inner space of the evaporation container and for receiving the raw sewage and a raw sewage introduction valve disposed under the stool and capable of closing an opened lower portion of the stool in addition to elements of the first aspect of the invention.

According to the fifth aspect of the invention, since the raw sewage introduction valve is provided on the covering plate and the stool is provided on the raw sewage introduction valve, the raw sewage discharged from the user passes through the raw sewage introduction valve, and drops into the evaporation container which is held under the raw sewage introduction valve. Accordingly, the route through which the raw sewage flows can be shortened so that a part to which the raw sewage is stuck can be minimized, thereby preventing the part through which the raw sewage passes from being dirty.

A further aspect of the invention is a raw sewage disposal apparatus as aforesaid, wherein the evaporation container is cylindrical at a peripheral surface thereof, and has an opened upper end-and a closed substantially horizontal bottom portion, and wherein a center of the bottom portion acts like a ridge, and a central axis line of the peripheral surface is positioned vertically. Since the central bottom portion of the evaporation container rises, the spherical stirring means accommodated in the evaporation container are rotated along the peripheral edge of the evaporation container and they are not localized at a specific portion. Further, since the stirring means move over the ridged projection formed on the center of the evaporation container, the mixture of the rotary holding means can be surely performed.

A still further aspect of the invention is a raw sewage disposal apparatus including the covering means of the first to fifth aspects of the invention which comprises a horizontal plate-shaped covering plate positioned adjacent to the opened upper end of the evaporation container. Since the covering plate for hanging the evaporation container is horizontal and plate-shaped, the upper end opening of the evaporation container is easily airtightly closed, and other instruments such as the stool is easily placed on the upper surface of the covering plate.

Another aspect of the invention is a raw sewage disposal apparatus including the rotary holding means, as aforesaid, which comprises an annular fixed ring fixed to the lower surface of the covering means and an annular rotary ring fixed to the opened upper end of the evaporation container, and which is assembled by engaging the fixed ring with the rotary ring by way of a bearing. Since the fixed ring and the rotary ring are assembled by way of bearings, the rotary ring connected to the upper opening of the evaporation container can be smoothly rotated and at the same time, the upper end opening of the evaporation container can be airtightly closed.

Still another aspect of the invention is a raw sewage disposal apparatus including the driving means which is fixed to the opened upper end of the evaporation container and comprises a rotary ring having a tooth surface at a circumferential surface thereof, a small gear engaging with the tooth surface of the rotary ring, and a motor for rotating the small gear. Since tooth surfaces are formed on the circumference of the rotary ring coupled to the upper end opening of the evaporation container, the small gear of the motor can mesh with the tooth surfaces, so that hanging and driving of the evaporation container can be performed commonly by the same member.

Still a further aspect of the invention is a raw sewage disposal apparatus including the movement restriction portion, as aforesaid, which comprises a flat-shaped baffle plate having a vertically positioned flat-surface, and a stirring plate connected to a lower side of the baffle plate so as to incline an upper surface thereof toward a center of the evaporation container. Since the movement restriction portion comprises the baffle plate and the stirring plate, and the stirring means contact the slightly inclined stirring plate, the stirring means are rolled on the inclined surface of the stirring plate and at the same time the raw sewage is vertically stirred which facilities the mixture of the raw sewage.

Other objects and purposes of the invention will be apparent to persons familiar with structures of this general type upon reading the following specification and inspecting the accompanying drawings.

BRIEF DESCRIPTION OF THE DRAWINGS

FIG. 18 is a truth table showing the relation between the operation of each portion of the raw sewage disposal apparatus;

DETAILED DESCRIPTION

First Embodiment (FIGS. 1 to 25):

A raw sewage disposal apparatus according to a first embodiment of the invention will be described with reference to FIGS. 1 to 25. Described in the embodiment is a temporary toilet 11 which is freely movable as a unit, and to which the raw sewage disposal apparatus according to the present invention is applied so as to be capable of temporary use at festivals, etc.

Figure 1:
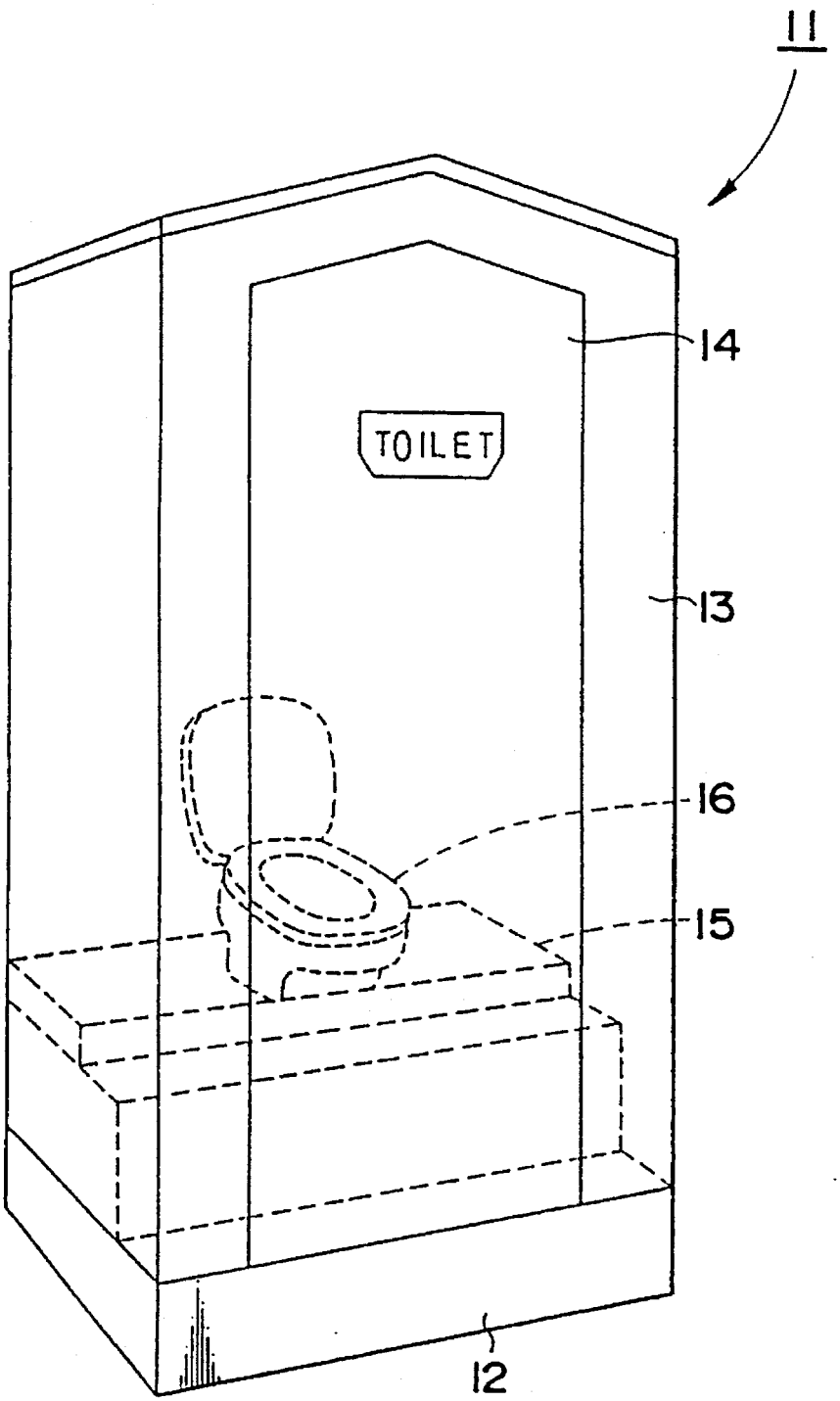
FIG. 1 is a perspective view showing a temporary toilet to which a movable raw sewage disposal apparatus is applied according to a first embodiment of the invention.

FIG. 1 shows an external appearance of the temporary toilet 11 of the first embodiment.

An outer frame or housing of the temporary toilet 11 is made of, e.g. plastic or reinforced synthetic resin and has a cubic box-like shape. The temporary toilet 11 has a base 12 which can be supported on the ground at the bottom side thereof. The base 12 has a cubic shape and has a roofed house 13 which is hollow and fixed at the upper portion thereof. A door 14 is attached to the front of the house 13.

The temporary toilet 11 contains a raw sewage disposal apparatus 15 which is fixed to an upper portion of the base 12 for drying and disposing of raw sewage. A western-style stool 16 is fixed to an upper central surface of the disposal apparatus 15.

Figure 2:
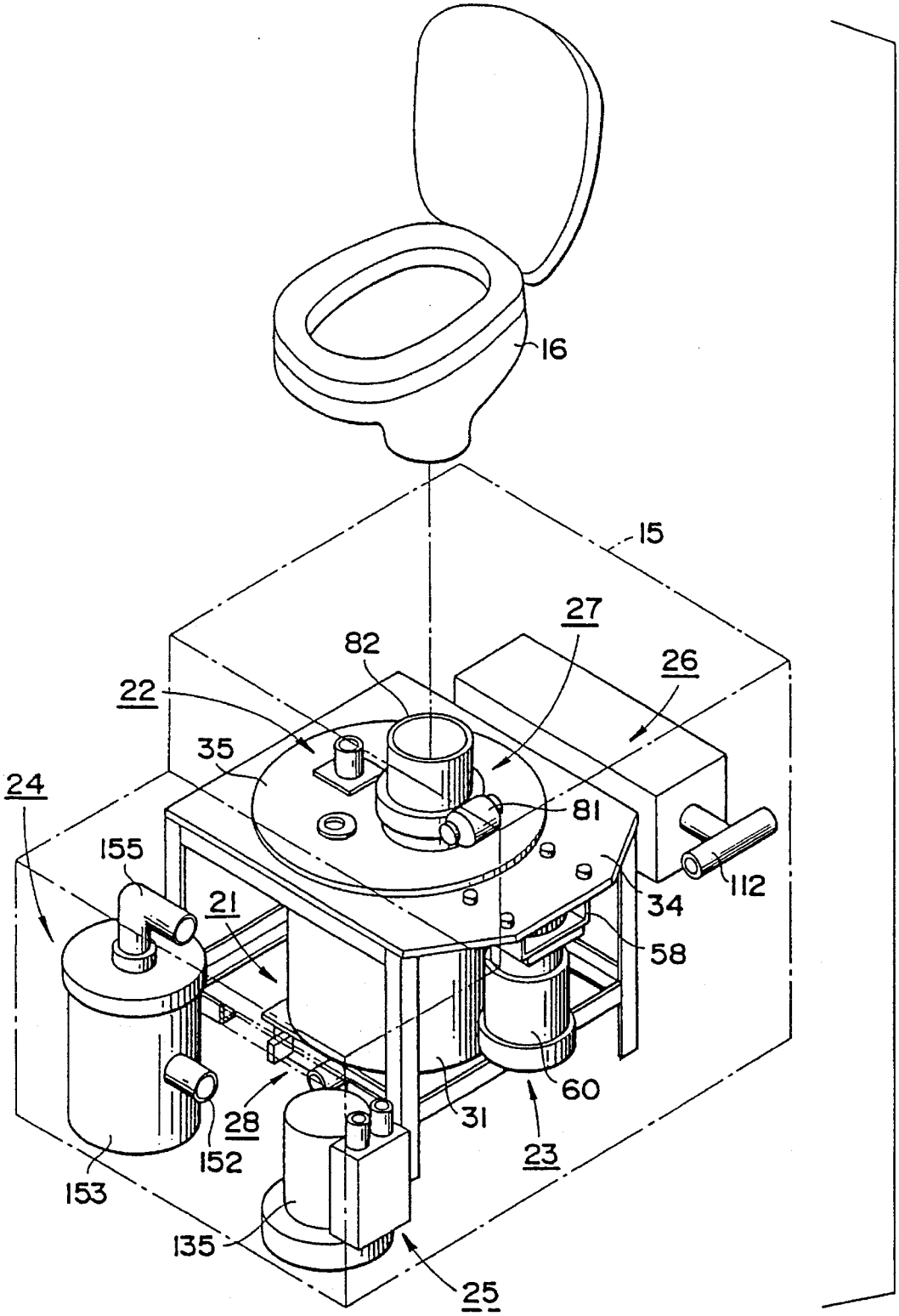
FIG. 2 is a skeleton diagram showing an arrangement of the entire raw sewage disposal apparatus.

FIG. 2 shows a structure of the inside of the disposal apparatus 15, with the main members of the disposal apparatus 15 being shown by solid lines, an external appearance thereof being shown by broken lines and the piping system connecting each member being omitted. The disposal apparatus 15 is assembled as a unit for facilitating assembly and maintenance thereof and is capable of operating by itself when power is supplied.

The disposal apparatus 15 generally comprises a drying portion 21, a dust suction portion 22, a rotary operation portion 23 (driving means), a dust separation portion 24, an air blower 25, a deodorizing portion 26, a raw sewage introduction portion 27 and a heating portion (electromagnetic heating means) 28.

An outer frame forming a body of the disposal apparatus 15 is assembled in a frame shape by squared pipe members, angle members, etc., and the external appearance of the outer frame is shown in FIGS. 2 by broken lines. The drying portion 21 constituting a main portion of the disposal apparatus 15 for heating and drying the raw sewage is disposed at the center of the body of the disposal apparatus 15. There is provided the dust separation portion 24 at the front (left front side in FIG. 2 is defined as front) left side of the drying portion 21 for separating dust from discharged air and collecting the thus separated dust. The air blower 25 is provided at the front right side of the drying portion 21 for supplying air to each component of the disposal apparatus 15. The rotary operation portion 23 is fixed to the right side surface of the drying portion 21. The raw sewage introduction portion 27 is fixed to the upper surface of the drying portion 21 at substantially the center thereof and communicates with a lower portion of the stool 16. The dust suction portion 22 is fixed to the upper surface of the drying portion 21 at left side thereof for sucking dust remaining inside the drying portion 21. The deodorizing portion 26 is rectangular and is disposed between the rear side of the drying portion 21 (right uppermost in FIG. 2 referred to as rear side) and the rear surface of the disposal apparatus 15 with its longitudinal direction thereof being horizontal, and the deodorizing portion 26 accommodates a filter and catalyst therein.

Figure 3:
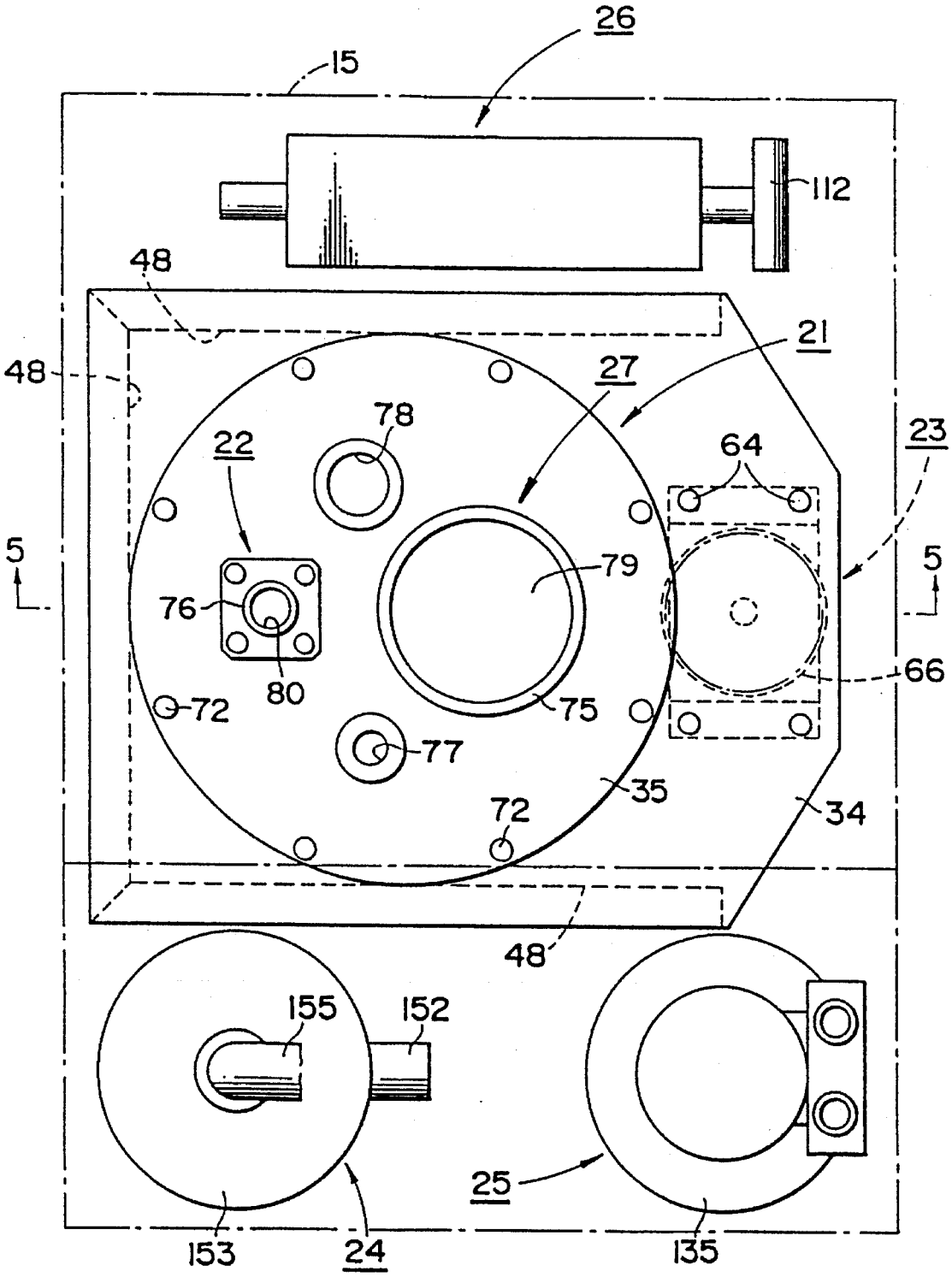
FIG. 3 is a plan view showing an arrangement of the entire raw sewage disposal apparatus.

FIG. 3 is a plan view of the disposal apparatus 15, with the outer frame of the disposal apparatus 15 being shown by broken lines and main components of the disposal apparatus 15 being shown by solid lines. A lower side in FIG. 3 corresponds to the front surface of the disposal apparatus 15 in FIG. 2.

The drying portion 21 is square flat shaped and is provided in the disposal apparatus 15 so as to occupy a central portion of the disposal apparatus 15. The rotary operation portion 23 for driving the drying portion 21 is fixed to the right side of the drying portion 21. The dust separation portion 24 is provided at the front (lower side in FIG. 3) left side of the drying portion 21 and the air blower 25 is provided at the front right side of the drying portion 21. The deodorizing portion 26 is provided at the rear side (upper side in FIG. 3 and rear side of the disposal apparatus 15) of the drying portion 21.

Figure 4:
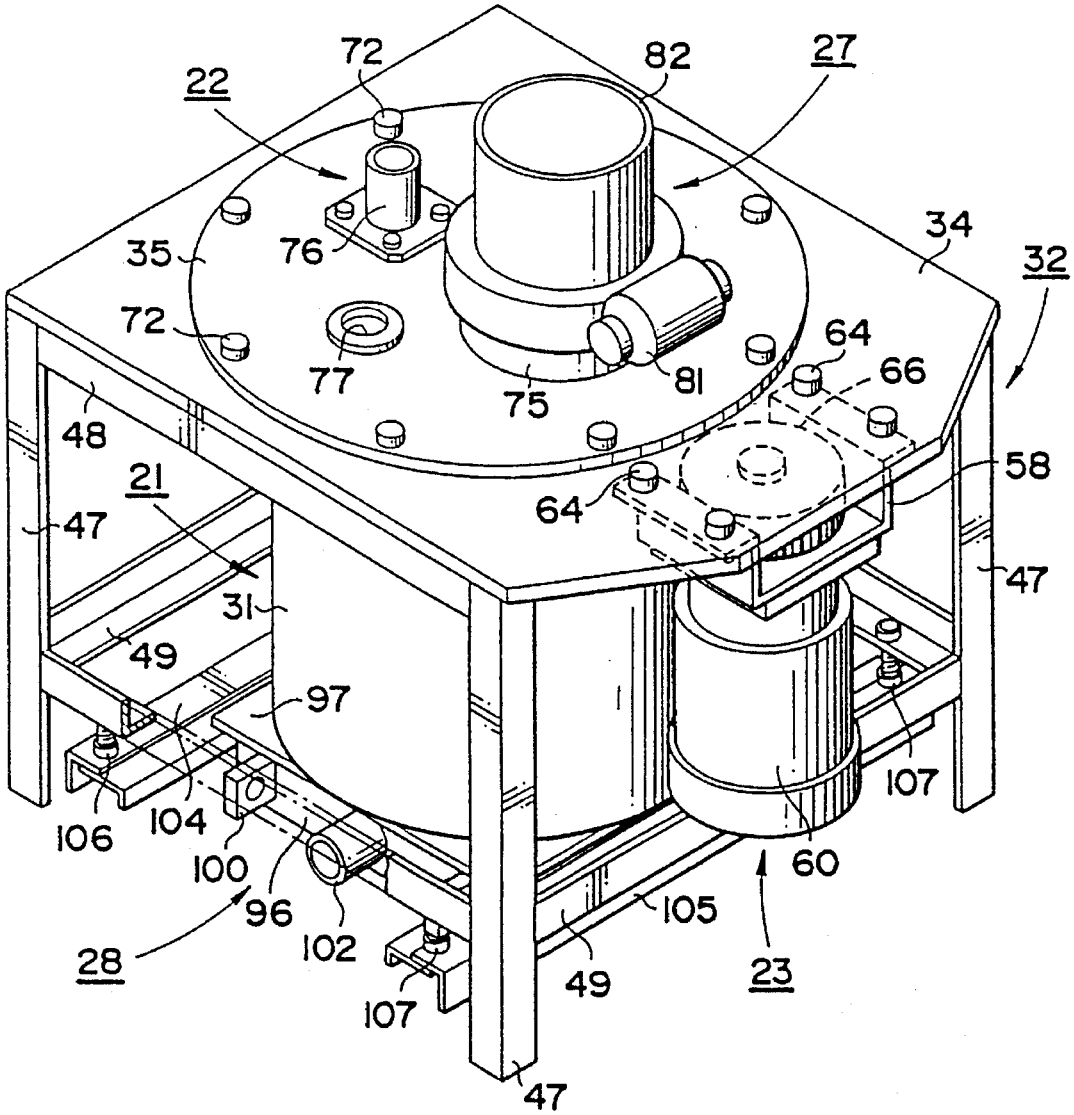
FIG. 4 is a perspective view showing an arrangement of a drying portion which is a main portion of the raw sewage disposal apparatus wherein a part is omitted.
Figure 5:
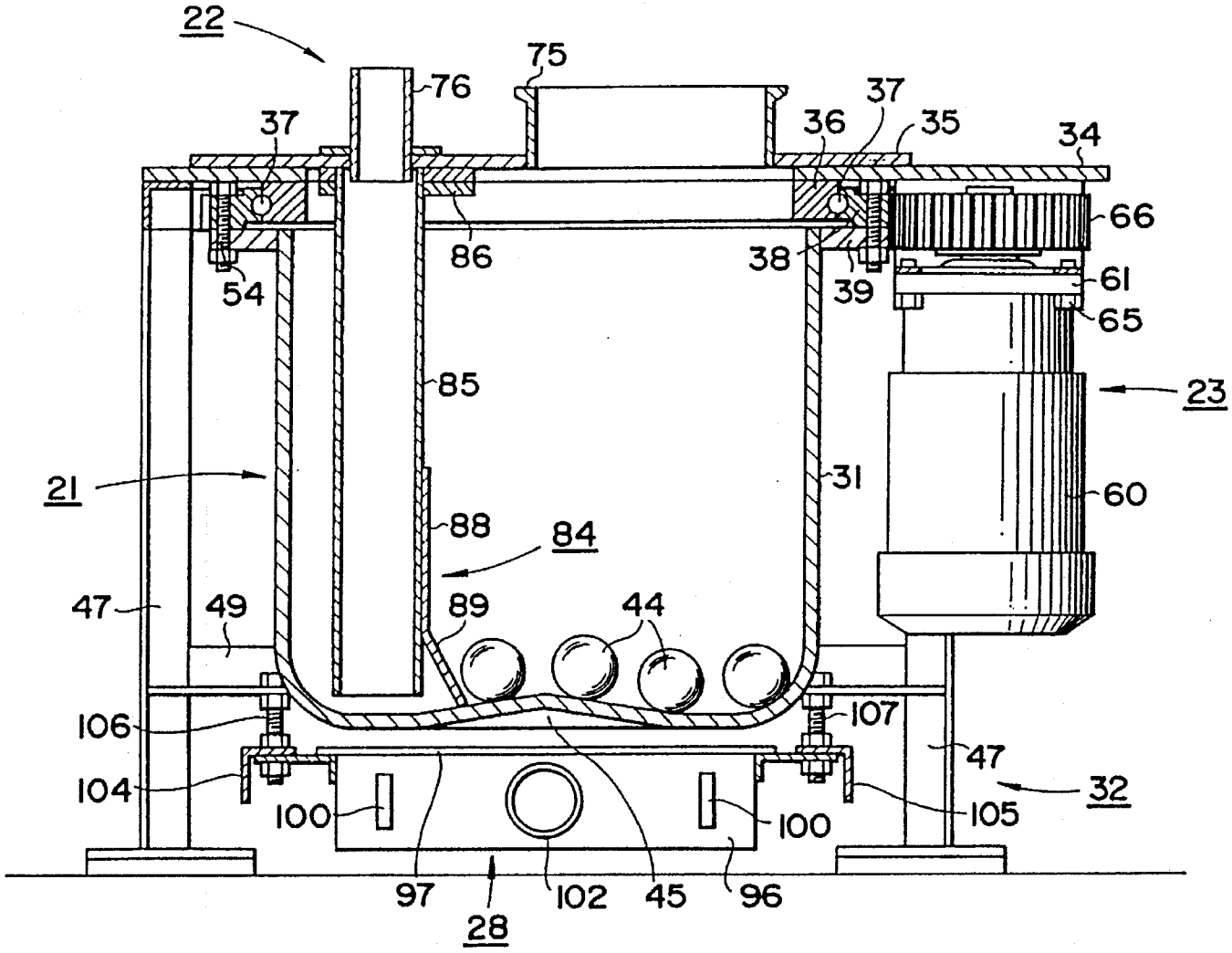
FIG. 5 is a longitudinal cross-sectional view taken along line 5—5 in FIG. 3.
Figure 6:
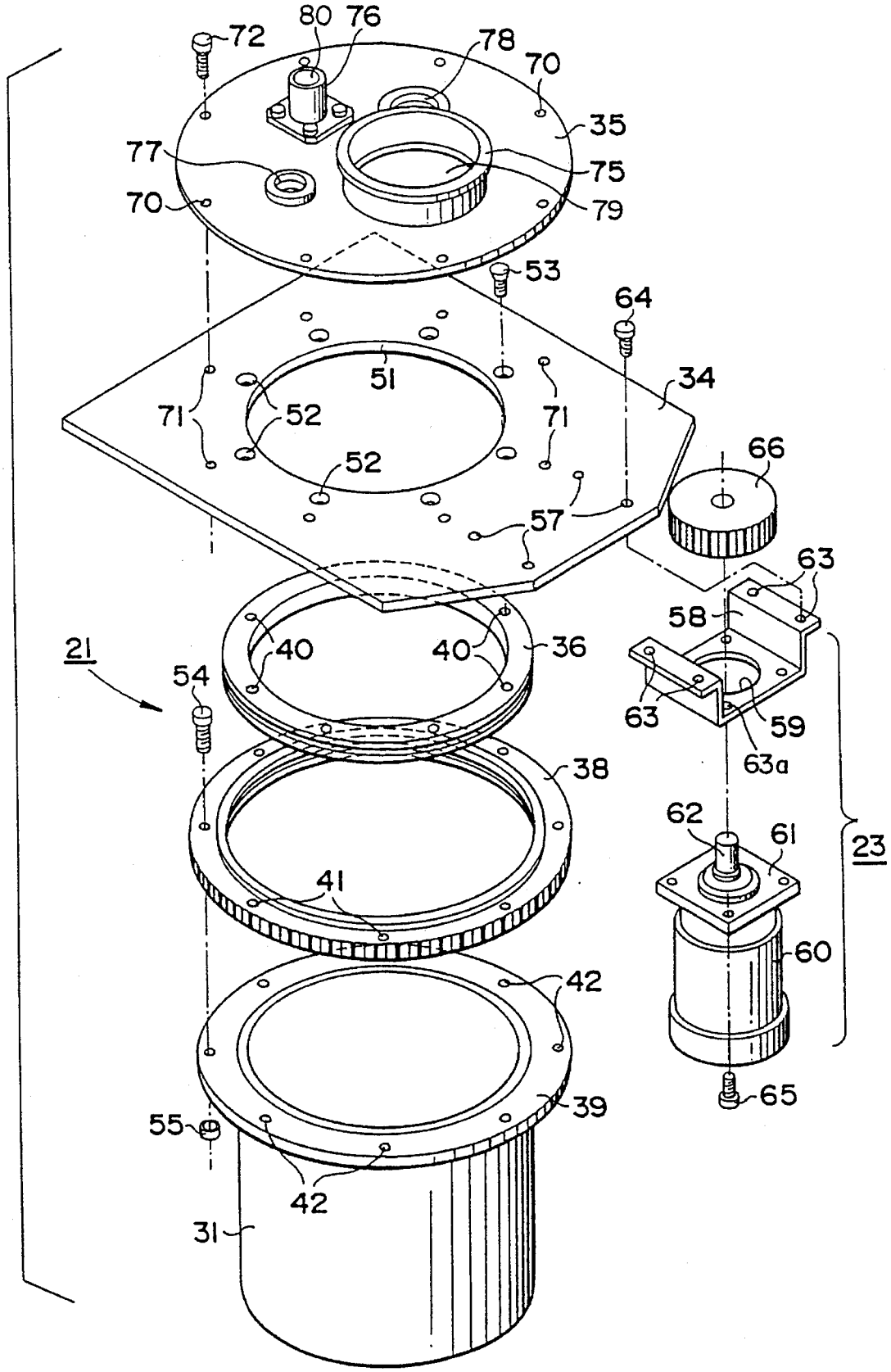
FIG. 6 is an exploded perspective view of constitutional elements of the drying portion of FIG. 4, wherein the constitutional elements are vertically spaced from one another.
Figure 7:
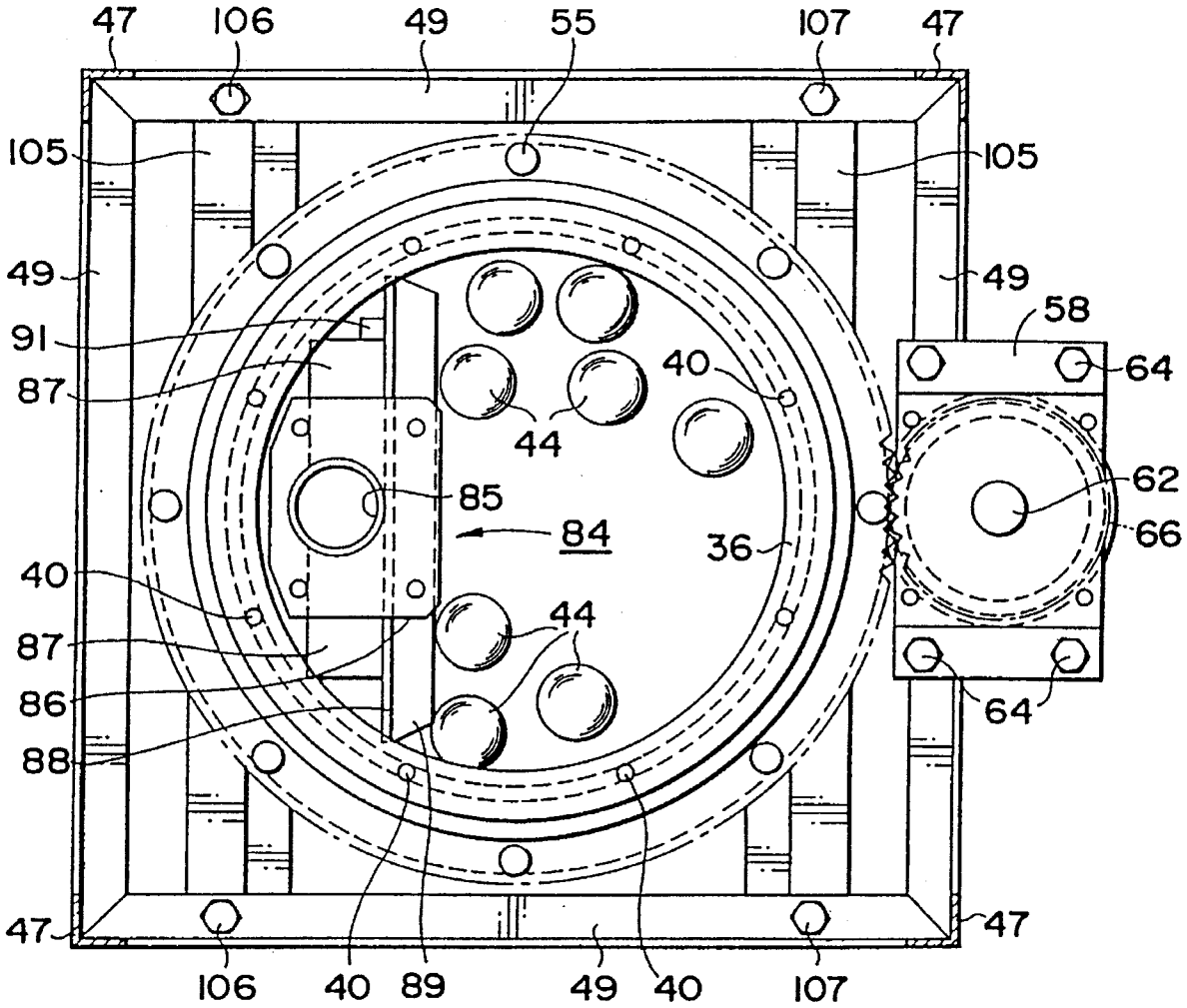
FIG. 7 is a plan view of an internal structure of a drying cauldron as viewed from the upper portion thereof, wherein a supporting plate which is a main portion of a drying portion of the raw sewage disposal apparatus is removed.

FIGS. 4 to 10 show structures of the drying portion 21, the dust suction portion 22, the rotary operation portion 23 and the raw sewage introduction portion 27. FIG. 4 is an enlarged view showing a state where the dust suction portion 22, the rotary operation portion 23, the raw sewage introduction portion 27 and the heating portion 28 in FIG. 2 are respectively connected to the drying portion 21, wherein a body (a part of stringer members at the front side) supporting the entire drying portion 21 is partly cut and omitted. FIG. 5 is a cross-sectional view of the disposal apparatus 15 taken along arrows 5—5 of FIG. 3, wherein parts of the rotary operation portion 23, etc. are not cut. FIG. 6 is a view showing a state where members constituting the drying portion 21 are vertically exploded and parts of screws for connecting each member are omitted. FIG. 7 is a view of the inside of a drying cauldron 31 as viewed from the upper side thereof, wherein the dust suction portion 22, the raw sewage introduction portion 27, a supporting plate 34, a covering plate 35 (the supporting plate 34 and the covering plate 35 constitute a covering means), etc. respectively covering an upper surface of the drying cauldron 31 are removed.

Figure 8:
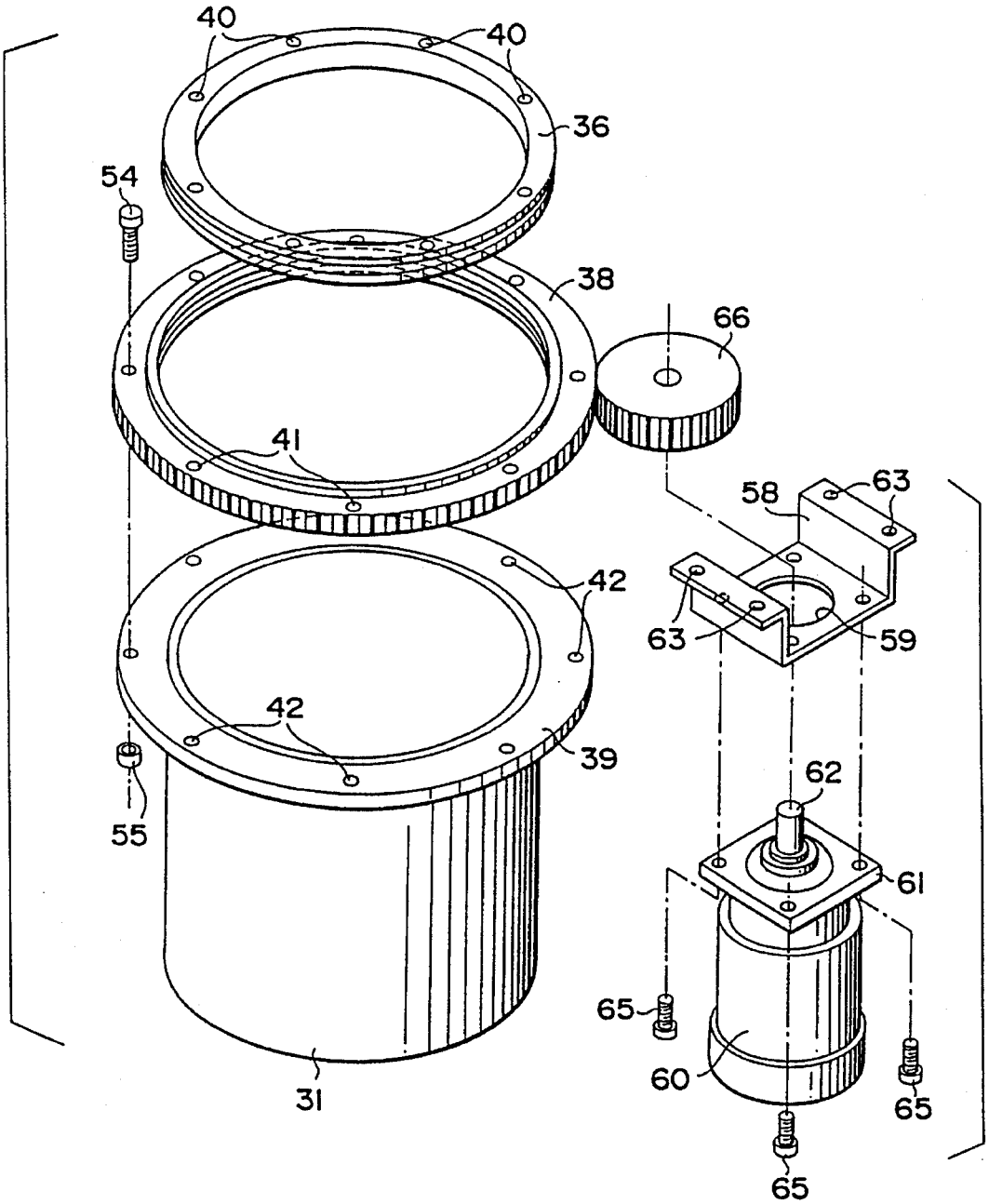
FIG. 8 is a side view of a mechanism for rotatably hanging and driving the drying cauldron which is the main portion of the drying portion of the raw sewage disposal apparatus is removed.
Figure 9:
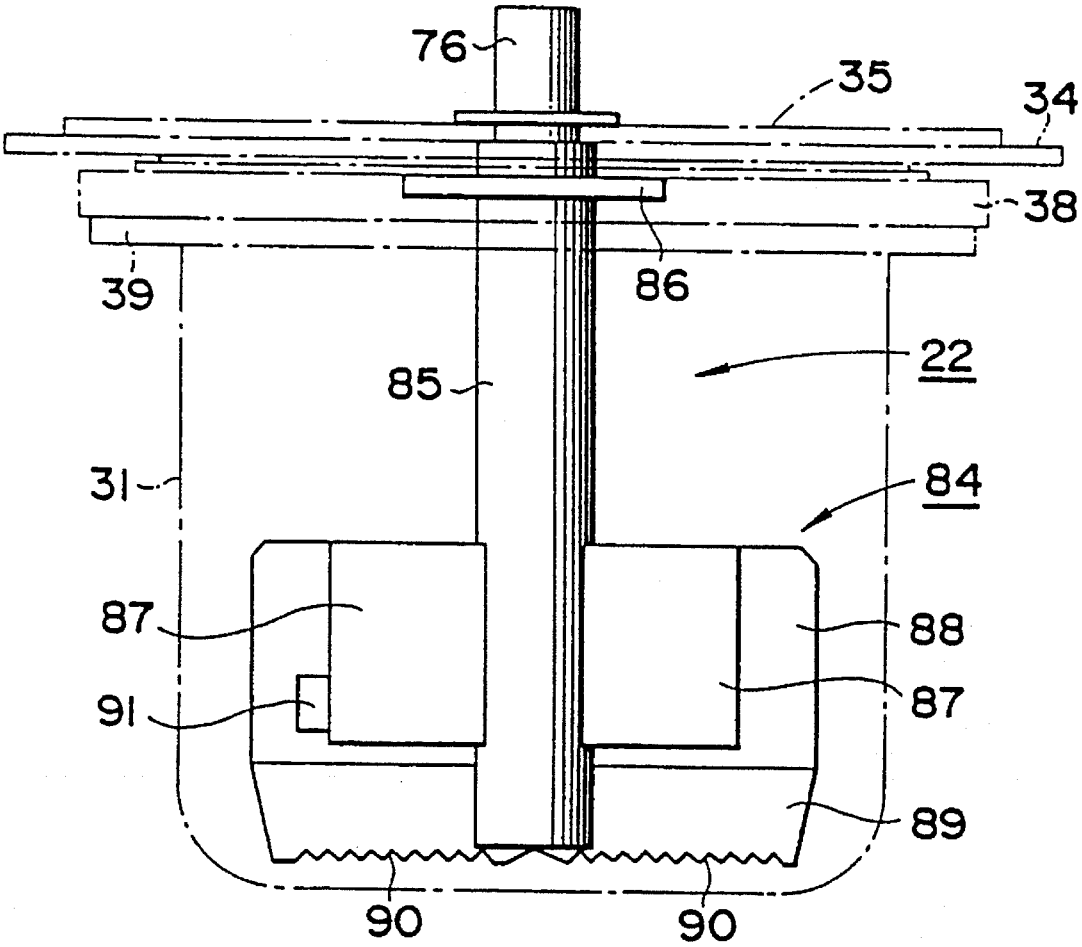
FIG. 9 is a side view of a dust suction portion of the raw sewage disposal apparatus, wherein the drying cauldron is omitted.
Figure 10:
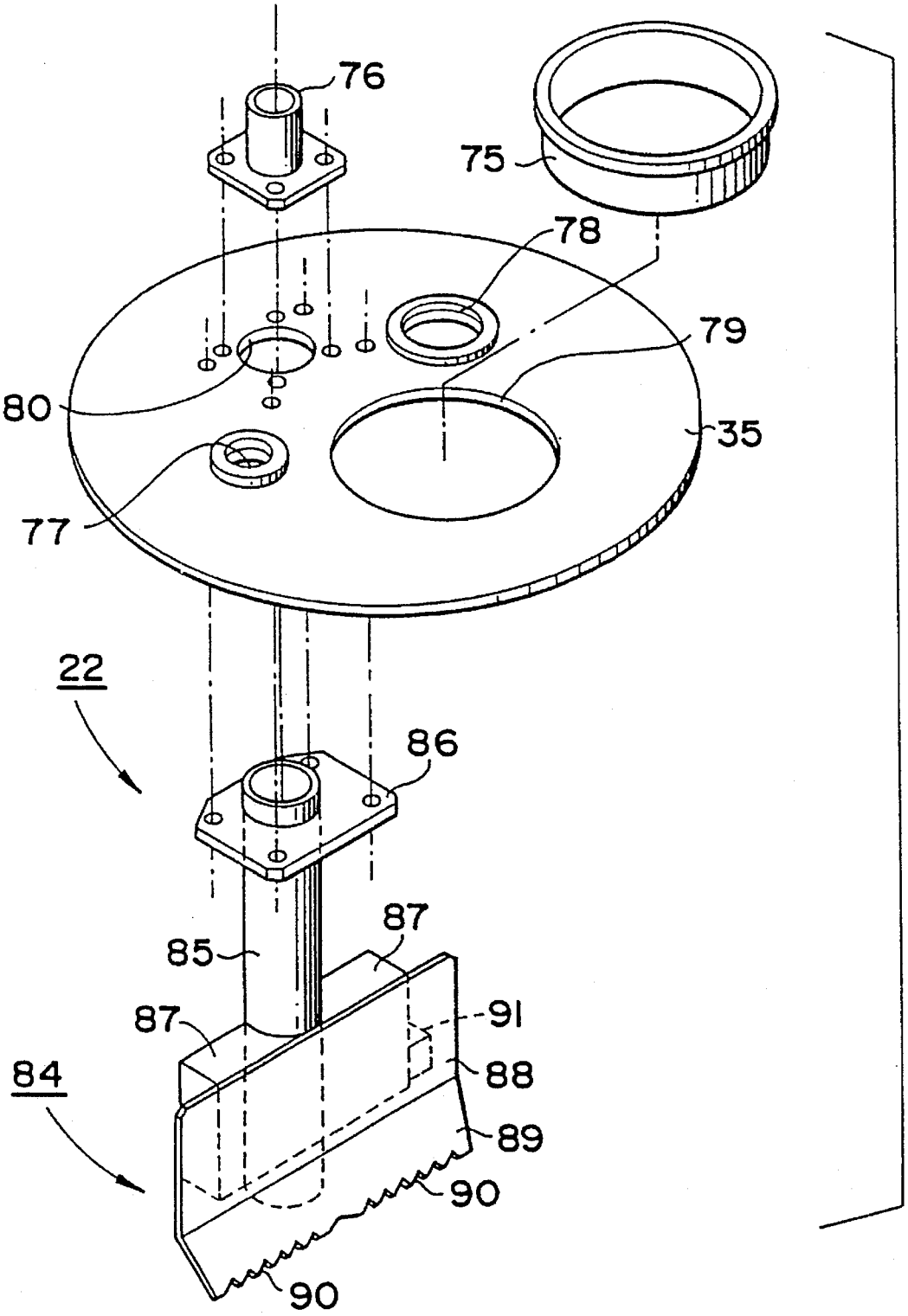
FIG. 10 is an exploded perspective view of each mechanism for showing the dust suction portion of the raw sewage disposal apparatus.

FIG. 8 shows a mechanism for rotatably supporting and also driving the drying cauldron 31. In the same figure, members constituting the drying cauldron 31 are vertically separated and bolts, etc. for connecting the same members are partly omitted. FIG. 9 is a view showing the structure of the dust suction portion 22 accommodated inside the drying cauldron 31, wherein the drying cauldron 31, etc. constituting the drying portion 21 are shown by broken lines and the dust suction portion 22 alone is shown by solid lines. FIG. 10 is a perspective view showing a concrete structure of the dust suction portion 22, wherein members constituting the dust suction portion 22 are vertically separated so as to clarify attachment of the dust Suction portion 22 to the covering plate 35.

As mentioned above, the structure of the drying portion 21 is described in detail with reference to FIGS. 4 to 8 with which each member constituting the drying portion 21 can be described hereinafter more in detail.

The drying cauldron 31 for heating and drying the raw sewage discharged from humans is provided at the center of the drying portion 21. The drying cauldron 31 is closed at the bottom thereof and opened at the upper end thereof, like a cylinder, and occupies most space of the drying portion 21. The drying cauldron 31 is made of a metallic material such as a heat resistant stainless steel, high-tension steel, etc. A longitudinal cross-sectional view of the drying cauldron 31 is illustrated in FIG. 5, wherein there is formed an upward projection 45 at the center of the bottom thereof. A top of the projection 45 is aligned with a central axial line of the drying cauldron 31, and an inner bottom surface of the drying cauldron 31 is gently inclined from the top toward the periphery thereof. As illustrated in FIGS. 6 and 8, an annular flange 39 is engaged around a peripheral edge of the opened upper end of the drying cauldron 31, and the upper end of the drying cauldron 31 and an inner periphery of the annular flange 39 are firmly connected to each other by electric welding, etc. without forming any gap therebetween. A plurality of insertion holes 42, which vertically penetrate the annular flange 39, are formed through the annular flange 39 at uniform angular intervals.

Described hereinafter is a supporting mechanism for hanging the drying cauldron 31 and at the same time for holding the dust suction portion 22, the rotary operation portion 23 and the raw sewage introduction portion 27. Members for supporting the drying cauldron 31, etc. comprise a frame 32 and the supporting plate 34. The frame 32 is an assembly of metallic channel members each having an L shape in cross section, namely, it is formed in such a manner that the metallic members are cut off and connected to one another by welding, etc. and they are assembled in solid.

The frame 32 comprises four legs posts 47 vertically raised at four corners, three upper stringer members 48 disposed horizontally at top portions of these leg posts 47, and four lower stringer members 49 disposed horizontally and spaced slightly above lower ends of the leg posts 47. The leg posts 47, the upper stringer members 48 and the lower stringer members 49 are respectively formed of channel members each having an L shape in cross section. The four leg posts 47 are cut in the same length and are positioned at four angles or corners of a square in a plan view of the frame 32, and each leg post 47 is disposed perpendicularly in the longitudinal direction thereof. The upper stringer members 48 cut in the same length bridge top portions of the leg posts 47, and they are disposed to form a U shape as viewed from above. Disposition of these upper stringer members 48 is shown by broken lines in FIG. 3, wherein the upper stringer member 48 does not bridge the top portions of the leg posts 47 at a right side of the disposal apparatus 15 (at right front side in FIGS. 2 and 4, and right side in FIG. 3) because an upper portion of the rotary operation portion 23 is fixed in a space where the upper stringer member 48 does not bridge top portions of upper stringer members 48.

The four lower stringer members 49 bridge between the four leg posts 47 respectively and are raised vertically slightly above the lower ends of the four leg posts 47. These lower stringer members 49 are arranged to form a square shape at a periphery of the lower portion of the frame 32, wherein they fix each leg post 47 at their positions as shown in FIGS. 4 and 7. In such a manner the leg posts 47, the upper stringer members 48 and the lower stringer members 49 form the frame 32 like a bird cage, and wherein the drying portion 21 and the other mechanisms are held by the frame 32.

The supporting plate 34 formed of a planar flat plate is placed on and fixed to an upper portion of the frame 32 which is assembled by the plurality of channel members 48 as mentioned above, wherein the drying cauldron 31 is rotatably hung by the supporting plate 34. The supporting plate 34 has a deformed hexagonal shape in its plan view, wherein one side of a square (right side toward the disposal apparatus 15) projects outwardly slightly in trapezoid, and wherein the rotary operation portion 23 can be fixed to the lower surface of the projected trapezoidal portion of the supporting plate 34. An introduction port 51 having a large diameter vertically penetrates the supporting plate 34 at the center thereof as shown in FIG. 6, and a plurality of screw holes 52 vertically penetrates the supporting plate 34 around the introduction port 51 in equal spaced intervals.

A fixed ring 36 is positioned under the supporting plate 34 and it has an annular opening having a large diameter at the center thereof, wherein an inner diameter of the fixed ring 36 is substantially the same as an inner diameter of the introduction port 51. A plurality of insertion holes 40 vertically penetrate the fixed ring 36 at the periphery thereof. The fixed ring 36 can be fixed to the lower surface of the supporting plate 34 by bringing the upper surface of the fixed ring 36 in contact with the lower surface of the supporting plate 34, aligning the screw holes 52 to the insertion holes 40 in their positions, and screwing each screw 53 through each screw hole 52. The fixed ring 36 has a bearing groove at an outer circumference thereof for accommodating a series of bearings 37 therein, described later.

A rotary ring 38 is positioned under the fixed ring 36 and it has an annular opening having a large diameter at the center thereof, wherein an outer diameter of the fixed ring 36 is set to be substantially the same as an inner diameter of the rotary ring 38. The rotary ring 38 has a bearing groove at an inner circumference thereof for accommodating a series of bearings 37. Teeth are formed on an outer circumferential surface of the rotary ring 38 in a given interval and a plurality of insertion holes 41 vertically penetrate the outer periphery of the rotary ring 38. The rotary ring 38 is connected and fixed to the annular flange 39, namely, to the drying cauldron 31 by bringing an upper surface of the annular flange 39 into contact with the lower surface of the rotary ring 38, aligning the insertion holes 41 to the insertion holes 42, inserting bolts 54 into the insertion holes 42 from above, screwing and fastening nuts 55 unto the upper ends of the bolts 54 exposed above the upper surface of the rotary ring 38.

An arrangement for assembling the fixed ring 36 with the rotary ring 38 and rotatably holding the fixed ring 36 and the rotary ring 38 will be now described. The fixed ring 36 is fixed to the lower surface of the supporting plate 34, and the rotary ring 38 is fixed to the annular flange 39 as mentioned above. In such a state, the bearings 37 of spherical shapes are interposed between each bearing groove of the fixed ring 36 and the rotary ring 38 so as to connect the fixed ring 36 and the rotary ring 38 with each other. As shown in FIG. 5, since the bearings 37 are disposed between the fixed ring 36 and the rotary ring 38, the rotary ring 38 is hung by the fixed ring 36 without dropping off from the fixed ring 36, and it is rotatably held by the bearings 37 in a circumferential direction thereof with less friction. A seal member made of synthetic resin in interposed between the fixed ring 36 and the rotary ring 38 and disposed in gaps defined in the bearing groove at upper and lower portions of the bearings 37, so that a gap between the fixed ring 36 and the rotary ring 38 is closed airtightly. As a result, the drying cauldron 31 is hung from the lower portion of the supporting plate 34, and at the same time the former is held by the latter so as to be smoothly rotatable in a circumferential direction (the vertical axis being a central axis of rotation). Structures of the fixed ring 36 and the rotary ring 38 are the same as a mechanism which has been so far called as a turning bearing. The fixed ring 36, the bearings 37 and the rotary ring 38 constitute a rotary holding means.

A mechanism for driving the drying cauldron 31 will be now described with reference to FIGS. 3 to 8.

The rotary operation portion 23 mainly comprises a motor support table 58, a motor 60 and a small gear 66. The motor table 58 is formed by bending a thin steel sheet in U shape and bending both ends outwardly, to the left and right, thereby forming end flanges. Screw holes 63 vertically penetrate the end flanges. An insertion hole 59 having a large diameter is formed in the motor table 58 at the center thereof, and four screw holes **63*a* are defined around the insertion hole 59. The motor 60 is electrically operated and cylindrical as a whole. A square flat seat 61 is fixed to the upper surface of the motor 60 and a motor output shaft 62 protrudes from the motor 60 through a center of the seat 61**.

The seat 61 has four screw holes defined at the corners thereof. To connect the motor 60 to the motor table 58, the motor shaft 62 projects from the insertion hole 59, wherein the upper surface of the seat 61 is brought into contact and aligned with the lower surface of the motor table 58. Screws 65 are inserted into screw holes of the seat 61 from the lower side thereof and further screw into the screw holes **63*a* of the motor table 58, so that the motor 60 can be fixed to the motor table 58. The small gear 66 is fixed to the motor shaft 62 projecting from the motor table 58, and it is rotatably accommodated in the recess of the motor table 58** formed between the side flanges thereof.

A part of the supporting plate 34 projects slightly from the right side in FIGS. 3–6, and four screw holes 57 are formed vertically therethrough. The motor table 58 is fixed on the supporting plate 34 by bringing upper surfaces of the end flanges of the motor table 58 into contact with the lower surface of the supporting plate 34, aligning the screw holes 57 with the screw holes 63, and screwing screws 64 through the screw holes 57 and 63. When the motor table 58 is fixed to the supporting plate 34, the tooth surface formed circumferentially of the small gear 66 engages with a tooth surface formed on the circumferential surface of the rotary ring 38. Accordingly, when the motor 60 is operated, the small gear 66 causes the rotary ring 38 as meshed with the small gear 66 to be rotated about the fixed ring 36. As a result, the drying cauldron 31 hung by the rotary ring 38 at the lower surface thereof and is rotated thereby.

The raw sewage is stored inside the drying cauldron 31 and it is evaporated when the drying cauldron 31 is heated. However, the raw sewage is not smoothly evaporated by merely heating the drying cauldron 31, and the stored raw sewage must be stirred at a uniform temperature. Accordingly, a plurality of heat holding balls 44 (stirring means) are inserted in the drying cauldron 31 for assisting the heating of the raw sewage and performing stirring operation. The stirring bodies are spherical and each made of metal such as iron, brass, or sintered ceramic.

Since the introduction port 51 having a large diameter is defined on the center of the supporting plate 34, and the inside of the drying cauldron 31 communicates with an outside the through the introduction port 51, bad smell flows out from the raw sewage introduced into the drying cauldron 31 through the introduction port 51. The discoid covering plate 35 is placed on the upper surface of the supporting plate 34 for closing the introduction port 51 as shown in FIGS. 2 to 6. The covering plate 35 is formed by cutting a thin steel sheet in circular shape. An outer diameter of the covering plate 35 is larger than the inner diameter of the introduction port 51. As shown in FIG. 6, there are four holes through the covering plate 35, namely, an introduction hole 77, a discharge hole 78, a throwing hole 79 (through which a coupling flange 75 is inserted), and a suction hole 80 (through which an air introduction pipe 76 is inserted). These four holes are arranged radially in four directions from the center of the covering plate 35, wherein the introduction hole 77, the discharge hole 78 and the suction hole 80 respectively having small diameters are positioned close to the throwing hole 79 having a large diameter so as to all be accommodated within the diameter of the introduction port 51. Positional relation between the throwing hole 79, the suction hole 80, the introduction hole 77 and the discharge hole 78 is illustrated in FIG. 3, wherein the throwing hole 79 is slightly displaced to the left from the center of the covering plate 35, the suction hole 80 is positioned at the side opposite to the throwing hole 79, and the introduction hole 77 and the discharge hole 78 are positioned at the left and right with respect to a line connecting the throwing hole 79 and the suction hole 80.

As shown in FIG. 6, screw holes 70 are defined through the periphery of the covering plate 35 in an equal interval, and a plurality of screw holes 71 are defined through the supporting plate 34 around the periphery of the introduction port 51 in the same interval from the center of the introduction port 51. The covering plate 35 is brought into contact with the supporting plate 34 so as to cover the introduction port 51, and the screw holes 70 are aligned with the screw holes 71, and the setscrews 72 are screwed into the screw holes 70 and 71 to fix the covering plate 35 to the supporting plate 34. Thus, the introduction port 51 is airtightly closed by the covering plate 35 so that the inner space of the drying cauldron 31 can communicate with the ambient atmosphere only through the introduction hole 77, the discharge hole 78, the throwing hole 79 and the suction hole 80. Since the periphery of the upper edge of the drying cauldron 31 is airtightly closed by the fixed ring 36 and the rotary ring 38, the inside of the drying cauldron 31 does not communicate with the ambient atmosphere so that air does not flow out from the inside of the drying cauldron 31.

The cylindrical coupling flange 75 is inserted into the throwing hole 79, and an inner edge of the throwing hole 79 and a lower end circumference of the coupling flange 75 are airtightly welded to each other. The air introduction pipe 76 has a lower end to which a square stop plate is fixed and it engages in the suction hole 80. The air introduction pipe 76 is fixed to the covering plate 35 by inserting screws into screw holes defined on the stop plate.

A structure of the raw sewage introduction portion 27 interposed between the stool 16 and the drying portion 21 will be now described with reference to FIGS. 2 and 4. As shown in FIG. 1, the raw sewage discharged from the user of the temporary toilet 11 is introduced into the stool 16, which must be introduced into the inner space of the closed drying cauldron 31. Accordingly, the raw sewage introduction portion 27 comprising a raw sewage introduction valve 81 and an introduction pipe 82 is interposed between the stool 16 and the drying portion 21.

The cylindrical coupling flange 75 which is opened at the upper and lower ends thereof is fixed to the throwing hole 79, and the inside of the drying cauldron 31 communicates with the ambient atmosphere through the coupling flange 75. The raw sewage introduction valve 81 accommodating an electrically operable butterfly valve therein is placed on the upper end of the coupling flange 75 fixed to the upper surface of the covering plate 35, and a thin pipe-shaped introduction pipe. 82 which is connected to the lower end opening of the stool 16 is placed on the upper portion of the raw sewage introduction valve 81. A flexible connecting pipe which has a continuous shape like a bellows and can be freely bent to the left and right while keeping a hollow inner diameter thereof, can be used to connect the lower opening of the stool 16 and the upper end opening of the introduction pipe 82.

Described in detail next is the dust suction portion 22 which functions to clean the dust remaining in the drying cauldron 31. The structure of the dust suction portion 22 is illustrated in FIGS. 5, 7, 9 and 10, in which FIG. 5 is a cross-sectional view longitudinally cutting the dust suction portion 22, FIG. 7 is a plan view as viewed from the upper portion thereof, FIG. 9 is a view as viewed from a rear surface thereof, wherein the structure of the drying cauldron 31 is denoted at dot chain line and FIG. 10 is an exploded perspective view wherein the upper and lower portions of the dust suction portion 22 is separated by the covering plate 35.

The dust suction portion 22 comprises two mechanisms provided on upper and lower surfaces of the covering plate 35. One upper mechanism is the air introduction pipe 76 provided on the upper surface of the covering plate 35 and the other lower mechanism is mainly formed of a suction pipe 85 provided on the lower surface of the covering plate 35. The air introduction pipe 76 comprises a pipe formed of a steel tube with the flat plate fixed thereto. A lower end of the air introduction pipe 76 is inserted into the suction hole 80 and fixed to the upper surface of the covering plate 35 by screwing the flat plate on the upper surface thereof. The suction pipe 85 is fixed to the lower surface of the covering plate 35 and comprises an elongate pipe formed of steel tube and a substantially square flat-shaped fixed plate 86 is fixed to the elongate pipe so as to be directed perpendicularly to an axial line of the elongate pipe as shown in FIG. 10. An upper surface of the fixed plate 86 is brought into contact with the lower surface of the covering plate 35 and then an axial line of the suction pipe 85 is aligned with an axial line of the air introduction pipe 76, and finally the fixed plate 86 is fixed to the covering plate 35 by screws, etc.

The air introduction pipe 76 and the suction pipe 85 are vertically joined with each other by fixing the suction pipe 85 to the covering plate 35 as shown in FIG. 5. In a state where the suction pipe 85 is vertically hung by the covering plate 35, the suction pipe 85 is located in the drying cauldron 31 in the manner that a lower end opening of the suction pipe 85 is positioned slightly above a bottom surface of the drying cauldron 31. The suction pipe 85 is not positioned at a center of the drying cauldron 31, but is positioned close to one side wall of the drying cauldron 31, and the axial line of the suction pipe 85 is positioned between the center axial line of the drying cauldron 31 and the one side wall of the drying cauldron 31. Accordingly, the suction pipe 85 is inserted into the interior of the drying cauldron 31, until it does not contact the bottom surface of the drying cauldron 31, and hence it does not obstruct the rotation of the drying cauldron 31.

The movement restriction portion 84 is provided at a lower portion of the suction pipe 85 for restricting rolling motion of the heat holding balls 44. The movement restriction portion 84 is illustrated in detail in FIGS. 7, 9 and 10. Reinforcing bodies 87 having same shapes and respectively formed by bending a steel sheet, etc. in a box shape are fixed to the lower portion of the suction pipe 85 at left and right sides thereof. A pair of reinforcing bodies 87 are arranged to be flush with each other, namely, arranged on the same straight line connecting thereof, and this line is perpendicular to a straight line connecting the central axis of the suction pipe 85 and the central axis of the drying cauldron 31. Accordingly, both ends of the pair of reinforcing bodies 87 are positioned to approach the inner wall of the drying cauldron 31, whereby a semicircular shape is formed between the pair of reinforcing bodies 87 and the inner wall of the drying cauldron 31.

A flat-shaped baffle plate 88 is brought into contact with and fixed to a side surface of the suction pipe 85 and each side surface of the reinforcing bodies 87 which are respectively directed toward the center of the drying cauldron 31 (at right side in FIG. 7, and at right front side in FIG. 10). The baffle plate 88 is formed by cutting a thin steel sheet in a rectangular shape, and it has an upper edge flush with upper surfaces of the reinforcing bodies 87 and a lower edge extending slightly lower than lower surfaces of the reinforcing bodies 87. Both sides of the baffle plate 88 extend so as to approach the inner wall of the drying cauldron 31. A stirring plate 89 which is slightly bent toward the central direction of the drying cauldron 31 (at right side in FIGS. 5 and 7, and at right front side in FIG. 10) is connected to the lower edge of the baffle plate 88. The baffle plate 88 and the stirring plate 89 may be formed by bending a single thin steel sheet. The baffle plate 88 and the stirring plate 89 are formed to have a substantially C or angled shape as viewed from the sides thereof as shown in FIG. 5. A lower end of the stirring plate 89 is positioned slightly above the bottom surface of the drying cauldron 31 so that the stirring plate 89 does not contact the lower surface of the drying cauldron 31 even if the drying cauldron 31 is rotated. Further, a saw portion 90 having wave-shaped notches or teeth is formed at the lower edge of the stirring plate 89.

A temperature sensor 91 is attached to the side surface of one of the reinforcing bodies 87 for detecting temperature inside the drying cauldron 31 and issues an electrical signal.

The heating portion 28 has a flat box-shaped external configuration and is held by the lower portion of the frame 32 as shown in FIGS. 4, 5, 11 and 12.

In the heating portion 28, a high-frequency coil 98 per se accommodated therein produces heat due to overcurrent loss and generates a high-frequency electromagnetic wave, and the heating portion 28 supplies the high-frequency electromagnetic wave to the drying cauldron 31 and heat holding balls 44, so that the drying cauldron 31 and the heat holding balls 44 are heated by induction heating owing to the electromagnetic wave generated by the high-frequency coil 98. The heating portion 28 is unitized for generating high-frequency electromagnet wave by the high-frequency coil 98. An internal structure of the heating portion 28 will be now described in detail with reference to FIG. 12.

An outer frame of the heating portion 28 is a hollow box-shaped coil container 95. The coil container 95 comprises a box-shaped body 96 which is opened at the upper end (forming an upper opening), and a covering plate 97 for closing the body 96. The body 96 has a square bottom portion and it is formed by bending a thin metal plate and raising four sides of a bottom portion thereof. The covering plate 97 is formed by cutting a thin metal plate in a square shape and has a plane surface which is slightly greater than a plane surface of the bottom portion of the body 96. When the covering plate 97 covers the body 96, four corners of the covering plate 97 stretch out to all directions. The coil container 95 is assembled by bringing the covering plate 97 in contact with the upper opening of the body 96 and fixing both body 96 and the covering plate 97 by screws or electric welding. An inside of the coil container 95 is hollow and is closed from the outside. An air suction pipe 101 is connected to a central portion of one side surface of the body 96 (at right innermost side in FIG. 11, and left innermost side in FIG. 12), and an air discharge pipe 102 is connected to a central portion of the other side surface of the body 96 (left front side in FIG. 11, and right front side in FIG. 12). Fresh air is introduced through the air suction pipe 101 into the coil container 95 which is airtightly sealed from the outside and air inside the coil container 95 is discharged through the air discharge pipe 102.

The high-frequency coil 98 formed of a cylinder which is short in height thereof and is fixed to a hollow internal central portion of the body 96 for generating high-frequency electromagnet wave as shown in FIG. 2. The high-frequency coil 98 is disposed inside the body 96 and is spaced from an internal surface of the body 96 in a given interval so that a circumferential surface thereof does not contact the internal surface of the body 96. Two ports, namely, the air suction pipe 101 and the air discharge pipe 102 are defined on two confronted side walls of the body 96, wherein air introduced through the air suction pipe 101 flows in an inner space of the body 96, and contacts a surface of the high-frequency coil 98 to thereby perform heat exchange, and thereafter it is discharged through the air discharge pipe 102. A pair of power lines 99 are connected to the high-frequency coil 98 for supplying power to the high-frequency coil 98, and both ends of the power lines 99 are connected to a pair of electrodes 100 which are insulated from and fixed to inner side walls of the body 96 (right front side in FIG. 12) wherein the air discharge pipe 102 protrudes. The pair of electrodes 100 protrude from the side wall of the body 96 and are positioned at the left and right portions of the air discharge pipe 102.

Figure 11:
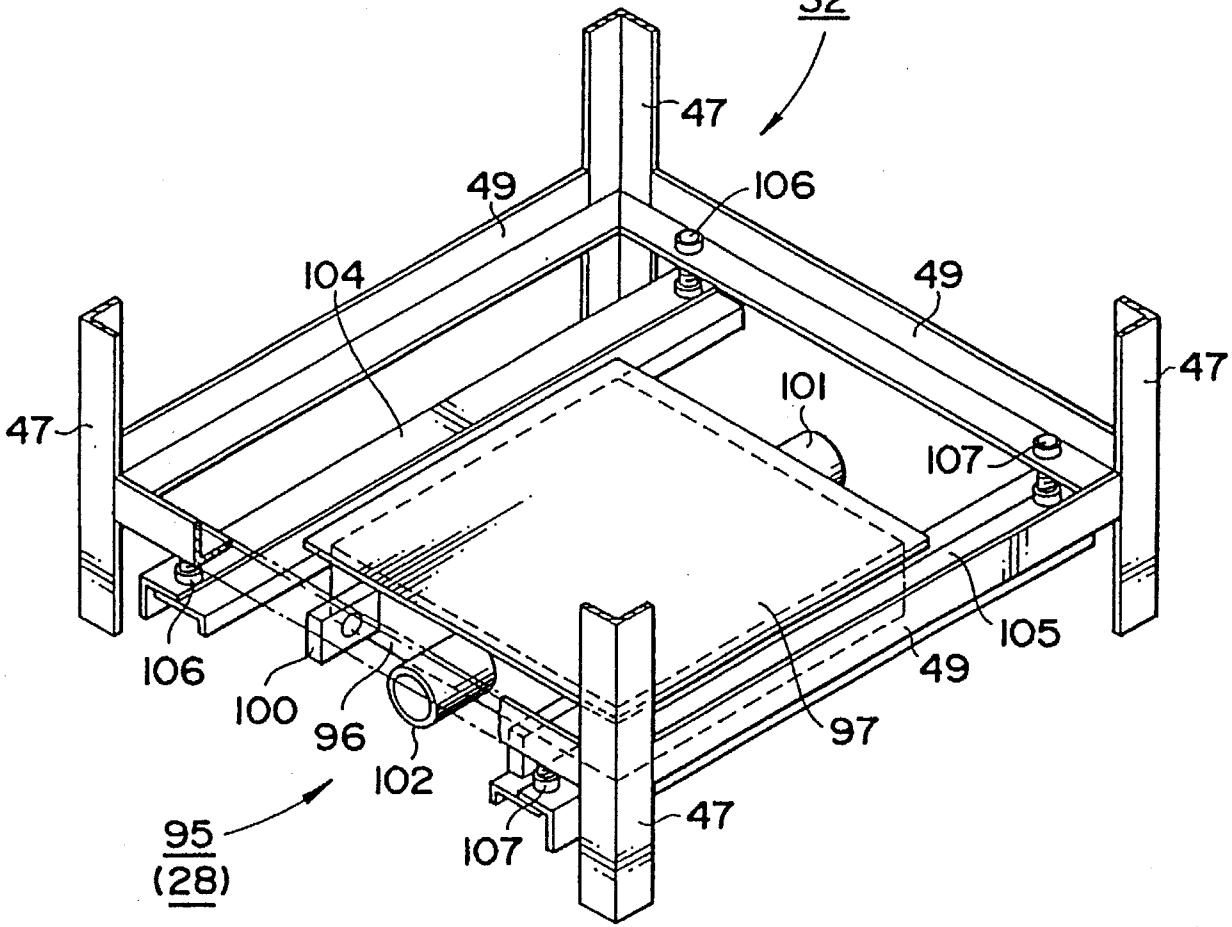
FIG. 11 is a perspective view of a mechanism for holding a heating portion of the disposal apparatus.
Figure 12:
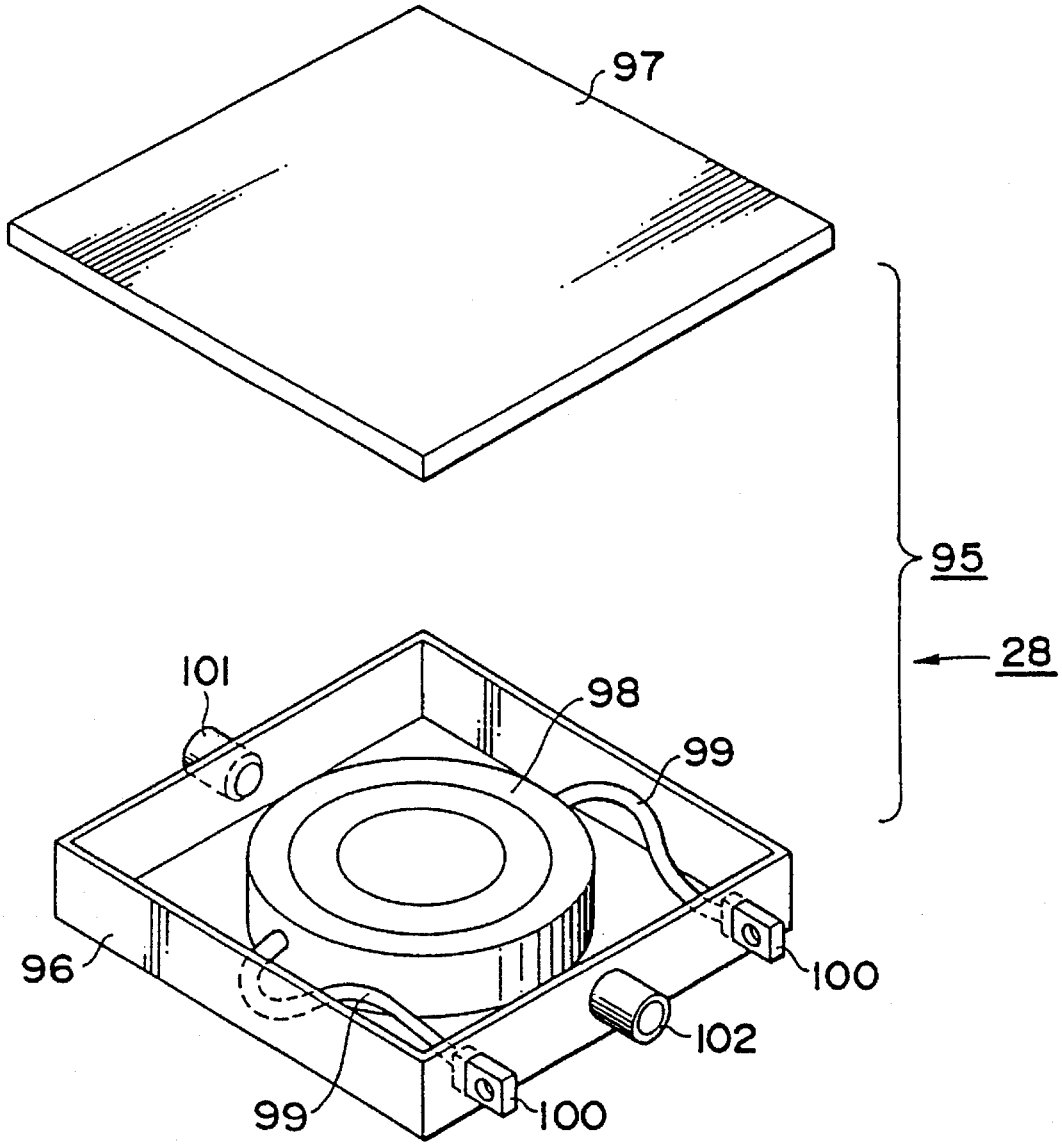
FIG. 12 is an exploded perspective view of an internal structure of the heating portion of the raw sewage disposal apparatus.

A structure for holding the coil container 95 by the frame 32 which is vertically spaced from the drying cauldron 31 will be now described with reference to FIG. 11.

Long hanging members 104 and 105 each having length corresponding to that of the lower stringer member 49 and formed by an L-shaped channel member are arranged between a pair of confronted lower stringer members 49 (left front side in FIG. 4 and right uppermost side in FIG. 11) inside a pair of lower stringer members 49 constituting the frame 32. The hanging members 104 and 105 are arranged in parallel with the pair of lower stringer members 49 (left uppermost side and right front side), and they are disposed horizontally. Both hanging members 104 and 105 are positioned at the left and right with a given interval. Both ends of the hanging member 104 are supported by the lower stringer member 49 by screwing hanging pins 106 which are hung from the lower stringer member 49. Both ends of the hanging member 105 is held under the lower stringer member 49 by hanging pins 106 which are hung from the lower stringer member 49. A distance between an inner surface of he hanging member 104 and an inner surface of the hanging member 105 is slightly longer than the width of the body 96. After the pair of hanging members 104 and 105 are disposed as shown in FIG. 11, the body 96 is inserted from an upper space between the pair of hanging members 104 and 105, and a lower surface of the covering plate 97 at the left and right portions thereof is made contact with the upper surfaces of the pair of hanging members 104 and 105, thereby holding the coil container 95 horizontally. When the coil container 95 is held by the pair of hanging members 104 and 105, an axial direction of the air suction pipe 101 and that of the air discharge pipe 102 are arranged to be in parallel with the pair of hanging members 104 and 105, and the air discharge pipe 102 is positioned in front of the disposal apparatus 15.

An internal structure of the deodorizing portion 26 disposed at a rear portion of the disposal apparatus 15 in FIGS. 2 and 3 (right uppermost side in FIG. 2, upper side in FIG. 3) will be now described in detail with reference to FIG. 13. The deodorizing portion 26 is provided for subjecting bad smell component of the evaporated raw sewage evaporated in the drying cauldron 31 to oxidation-reduction so as to prevent the bad smell component from escaping from the temporary toilet 11.

Figure 13:
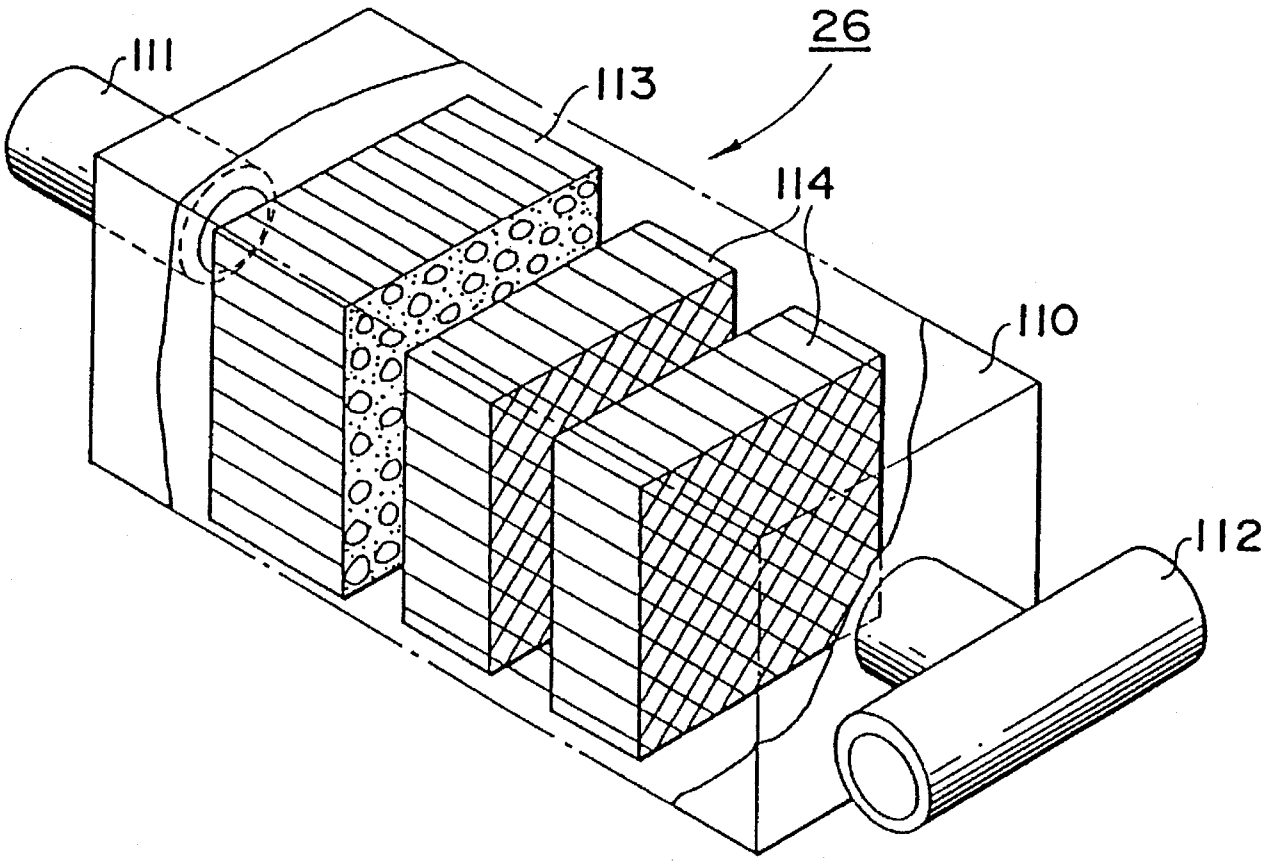
FIG. 13 is a perspective view of the internal structure of a deodorant portion of the raw sewage disposal apparatus, wherein a part thereof is shown by a dot chain line.

An outer appearance of the deodorizing portion 26 has a rectangular box shape which is closed from the outside as shown in FIG. 13. An outer shell of the deodorizing portion 26 comprises a box-shaped deodorizing box 110 formed by bending a thin metallic plate, and this deodorizing box 110 is hollow and airtightly sealed from the outside. Long side surfaces of the deodorizing box 110 are disposed horizontally. An air exhaust pipe 111 is connected to a center of one of substantially square side surfaces disposed at both ends of the deodorizing box 110 (left side in FIG. 13) and a suction side of an ejector 112 is connected to a center of the other square side surface (right side in FIG. 13).

A filter 113 comprising one unit and a catalyst 114 comprising two units are accommodated inside the deodorizing box 110. The filter 113 is formed by overlapping material made of ceramic fibers, etc. The filter 113 has an outer shape which is the same as a cross-sectional view of the air exhaust pipe 111 and it is disposed in a manner that air flowing inside the deodorizing box 110 must pass through the filter 113.

When the air flows in the filter 113, dust in the air can be adsorbed by fine fibrous meshes of the material thereof. The catalyst 114 is formed of a ceramic honeycomb structure having fine meshes. Coarse particles of previous metal such as platinum, are inserted into each hole of the honeycomb structure. Each catalyst 114 has an outer shape which is the same as a cross-sectional view of the air exhaust pipe 111 and it is arranged in a manner that the air flowing inside the deodorizing box 110 must pass through the catalyst 114. The catalyst 114 comprises two units which are the same in shape and accommodated in two stages inside the deodorizing box 110 at a portion close to the ejector 112 rather than the filter 113.

An entire outer periphery of the deodorizing box 110 is covered by a heat insulating material such as ceramic fibers, etc., and further, an entire outer periphery of the heat insulating material is wrapped by aluminum foil having heat insulating effect not to irradiate heat of the deodorizing box 110 outside the deodorizing box 110.

Figure 14:
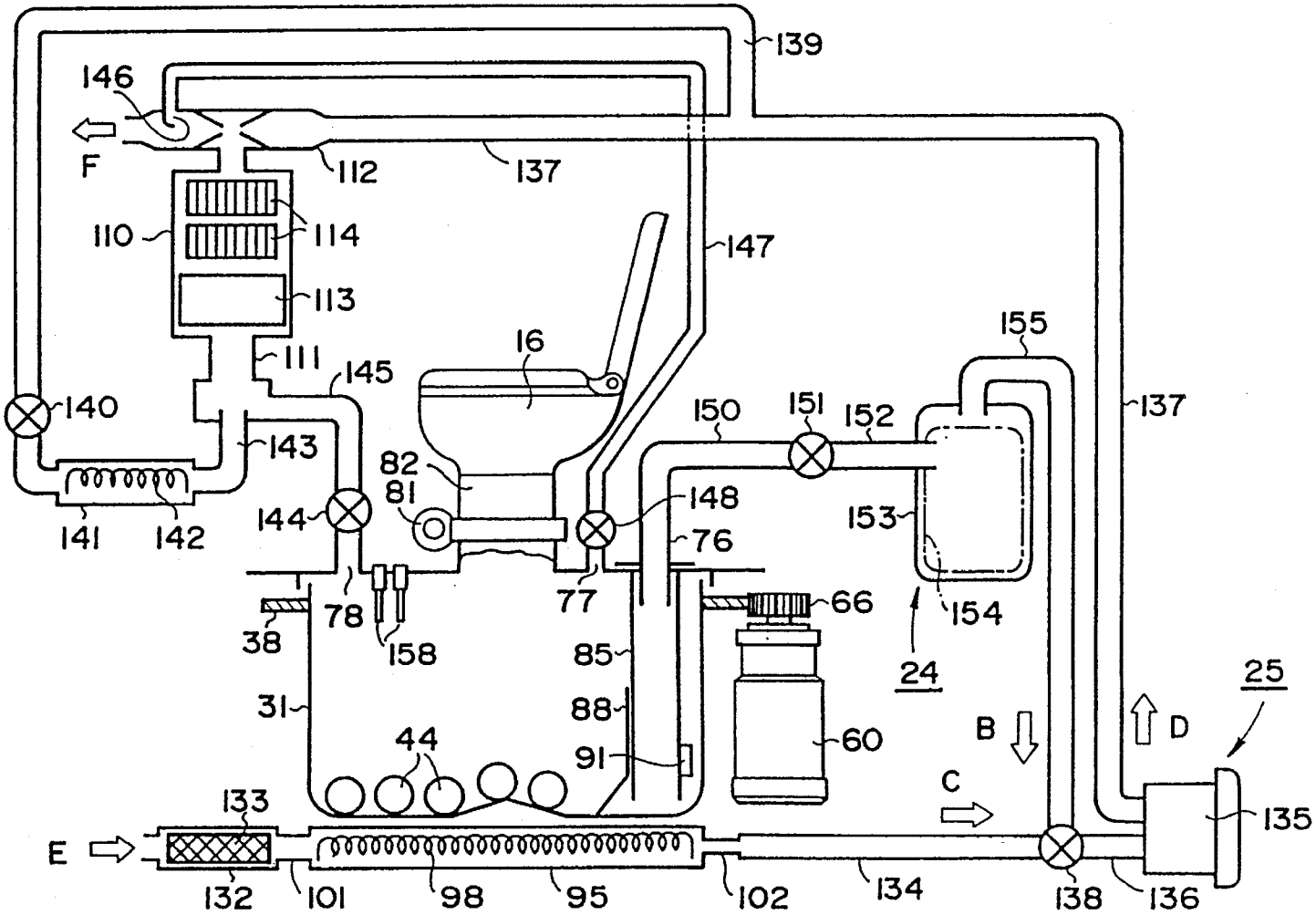
FIG. 14 is a view explaining a piping connection of each mechanism of the raw sewage disposal apparatus.

Piping for connecting each mechanism inside the disposal apparatus 15 will be described with reference to FIG. 14. In FIG. 14, piping for flowing the raw sewage from the stool 16 to the drying cauldron 31 and each piping from permitting the air to flow from an air blower 135 of the air blower 25 to each mechanism such as the ejector 112.

A filter box 132 has one end connected to the air suction pipe 101 of the coil container 95 for supplying the air from the ambient atmosphere inside the disposal apparatus 15, and the other end opened to the ambient atmosphere. The hollow filter box 132 is airtightly sealed from the outside, and has a pair of opening portions in which one opening portion is connected to the air suction pipe 101 and the other opening is opened to the ambient atmosphere. A filter 133 is accommodated inside the filter box 132 for catching dust contained in the air sucked from the ambient atmosphere. An intake pipe 134 has one end connected to the air discharge pipe 102 of the coil container 95 and the other end connected to one side of a selector valve 138 which can be selected to three directions.

The air blower 25 includes the air blower 135 as its main constitutional member of sucking the air and supplying the air under pressure, and a common side of the selector valve 138 is connected to a suction pipe 136 provided at a suction side of the air blower 135. An air discharge pipe 137 has one end connected to an air supply side of the air blower 135 for supplying the air under pressure, and the other end connected to an air introduction side of the ejector 112. A bypass pipe 139 which is small in a diameter has one end connected to a middle portion of the air discharge pipe 137, and the other end is connected to one end of a closing valve 140 for performing a closing operation. The other end of the closing valve 140 is connected to one end of a reheating box 141. The reheating box 141 is hollow, and has openings which are defined at both ends thereof for permitting the air to flow therethrough. The reheating box 141 has a heater 142 at the inside thereof for heating the flowing air.

The reheating box 141 functions to heat the air introduced through the bypass pipe 139 and keep the heated air at high temperature. A hot-air pipe 143 is connected to the other end of the reheating box 141. A distal end of the hot-air pipe 143 is connected to the air exhaust pipe 111. An air discharge pipe 145 has a distal end connected to a side surface of the air exhaust pipe 111. The hot-air pipe 143 has an opening slightly protruded inside the air exhaust pipe 111. The opening provided at the distal end of the air discharge pipe 145 is disposed at the side surface of the distal end of the hot-air pipe 143, wherein the air introduced through the air discharge pipe 145 is swirled helically in the air exhaust pipe 111 about the hot-air pipe 143. A closing valve 144 has one end connected to the other end of the air discharge pipe 145 for performing the closing operation, and the other end connected to the discharge hole 78 which communicates with the inside of the drying cauldron 31 (refer to the discharge hole 78 in FIG. 6).

The ejector 112 functions to permit the air introduced through the air discharge pipe 137 to pass therethrough as it is and disperse the same air into the atmosphere. The ejector 112 has a throttled portion of air route at the inner central portion thereof. The airtight deodorizing box 110 has an air outlet end connected to a side surface of the throttled portion of the ejector 112 (a pair of openings are provided at both sides of the deodorizing box 110, wherein one opening connected to the air exhaust pipe 111 is defined as an air inlet end, and the other opening connected to the ejector 112 is defined as the air outlet end). When the air under pressure supplied from the air discharge pipe 137 passes through the inside of the ejector 112, it runs at high speed into the throttled portion of the ejector 112 so that the throttled portion is negatively pressurized at the portion surrounding thereof. As a result, the ejector 112 can suck the air at the center thereof from the air outlet of the deodorizing box 110. In such a manner, the ejector 112 can diffuse the air supplied from the air discharge pipe 137 to the ambient atmosphere, suck the air inside the deodorizing box 110, and mix the air supplied from the air discharge pipe 137 with the air inside the deodorizing box 110 and disperse the mixed air to the ambient atmosphere.

An air introduction port 146 is defined at an inner side surface of an end of the ejector 112 through which the air is exhausted for introducing a part of the air thereinto, and a tip end of an auxiliary pipe 147 is connected to the air introduction port 146. A closing valve 148 has one end connected to a distal end of the auxiliary pipe 147, and the other end connected to the introduction hole 77 which communicates with the inside of the drying cauldron 31 (refer to the introduction hole 77 in FIG. 6).

An air discharge pipe 150 has one end connected to an upper end of the air introduction port 76 constituting the dust suction portion 22, and the other end connected to one end of a closing valve 151. A dust pipe 152 is connected to the other end of the closing valve 151. The dust separation portion 24 has a structure similar to a dust separating mechanism of a vacuum cleaner, and comprises a dust collecting box 153 which is hollow and closed from the outside and a dust bag 154 accommodated inside the dust collecting box 153.

The dust bag 154 employs a material such as paper and a cloth which does pass the air therethrough but does not pass the dust therethrough. The material is stitched in a closed bag shape and can separate the dust contained in the air introduced from the dust pipe 152 at a film surface thereof. The dust bag 154 is swollen so that an inner space of the dust collecting box 153 is filled with the air. The terminal end of the dust pipe 152 is connected to the dust bag 154 so as to open to the inside of the dust bag 154. Accordingly, the terminal end of the dust pipe 152 communicates with only the inner space of the baggy shaped dust bag 154, wherein the air entered the inside of the dust pipe 152 passes through the film surface of the dust bag 154 and flows inside the inner space of the dust collecting box 153. An intake pipe 155 has one end connected to the dust collecting box 153 for communicating with the inner space of the dust collecting box 153 and the other end connected to the other selecting side of the selector valve 138.

A pair of liquid level sensors 158 are provided inside the drying cauldron 31 as shown in substantially the center of the drying cauldron 31. The pair of liquid level sensors 158 has a base fixed to a lower surface of the covering plate 35, and the pair of liquid level sensors 158 are positioned between the introduction hole 77 and the discharge hole 78 and fixed between the introduction hole 77 and the discharge hole 78 with a given interval. The pair of liquid level sensors 158 are disposed to hang vertically inside the interior of the drying cauldron 31. The liquid level sensors 158 are positioned so that lower ends thereof reach or are flush with an allowable liquid height of the raw sewage which is filled in the drying cauldron 31. Base portions of the pair of liquid level sensors 158 fixed to the lower surface of the covering plate 35 are respectively electrically insulated from the covering plate 35. Conductive metallic material are exposed from tip ends (lower ends) of the pair of liquid level sensors 158, wherein current flows when the liquid surface of the raw sewage contacts the tip ends of the pair of liquid level sensors 158, so as to judge that the raw sewage is introduced into the drying cauldron 31 to a limit height to which the raw sewage can be accommodated in the drying cauldron 31.

Figure 15:
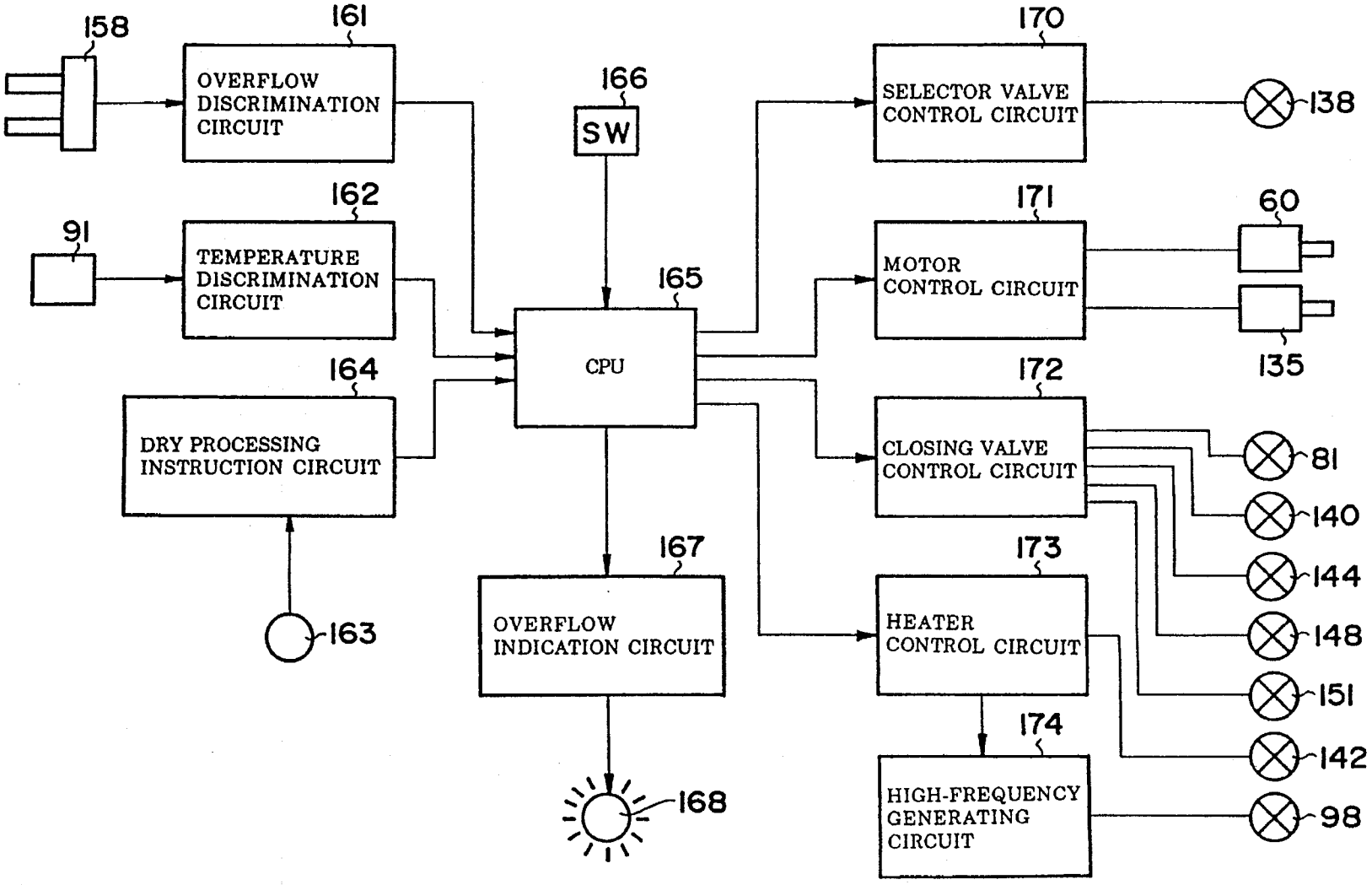
FIG. 15 is a block diagram showing an electric system for controlling the entire operation of the raw sewage disposal apparatus.

A structure of an electric system for automatically controlling the disposal apparatus 15 of the invention will be now described with reference to a block diagram in FIG. 15. A mechanism of the disposal apparatus 15 is controlled by a central processing circuit 165 comprising a CPU (microprocessor, central processing element, etc.), a nonvolatile memory (ROM), etc. (central processing circuit 165 is hereinafter referred to as a CPU 165). Accordingly, the disposal apparatus 15 can be operated at an optimum condition in accordance with previously determined procedures and conditions, and it can be automatically stopped in case of trouble or inappropriate conditions.

An output signal issued by the liquid level sensor 158 is input into a overflow discrimination circuit 161. A discrimination signal issued by the overflow discrimination circuit 161 is input into the CPU 165. An output of the temperature sensor 91 for detecting change of temperature inside the drying cauldron 31 is input into a temperature discrimination circuit 162. The discrimination signal issued by the temperature discrimination circuit 162 is input into the CPU 165. When the user completes use of the temporary toilet 11 provided inside the house 13, he depresses an instruction switch 163 (not shown in FIG. 1). The instruction switch 163 outputs an instruction signal representing the completion of use of the temporary toilet 11 to a dry processing instruction circuit 164. A control signal issued by the dry processing instruction circuit 164 is input into the CPU 165. A signal issued by a power switch 166 for starting entire operation of the disposal apparatus 15 is also input into the CPU 165.

The CPU 165 compares various input signals with conditions of programs as stored therein, and it outputs a plurality of signals for operating various mechanisms provided in the disposal apparatus 15 based on result of comparison. First, an output of the CPU 165 is input into an overflow indication circuit 167 which is connected to an indication lamp 168 capable of emitting light for representing stop of temporary use of the stool 16. An independent output signal of the CPU 165 is input into a selector valve control circuit 170, a motor control circuit 171, a closing valve control circuit 172 and a heater control circuit 173. The selector valve 138 is connected to an output of the selector valve control circuit 170. The selector valve 138 switches the suction pipe 136 alternately to the intake pipe 134 or the intake pipe 155. The motor 60 and the air blower 135 are respectively connected to the motor control circuit 171 which can control rotation of the motor 60 and the air blower 135 in a normal direction or a reverse direction. The raw sewage introduction valve 18, the selector valve 138, and the closing valves 140, 144, 148, 151 are respectively connected to the closing valve control circuit 172 which can control the opening or closing of these valves. The heater 142 and a high-frequency generating circuit 174 is connected to a heater control circuit 173, and the high-frequency coil 98 is connected to the high-frequency generating circuit 174. Power is supplied to the heater 142 and a high-frequency power generated in the high-frequency generator circuit 174 is supplied to the high-frequency coil 98.

Functions of the present embodiment will be described more in detail separately in accordance with each operating condition.

The power switch 166 is turned off in a state where the temporary toilet 11 is not kept inside the warehouse, or in a state where the temporary toilet 11 is installed in a festival but it is not used during night or holiday, so that each function of the disposal apparatus 15 maintains its stopping condition. The CPU 165 maintains its stopping condition upon reception of the signal output from the power switch 166 when the power switch 166 is turned off, and it supplies a stop signal to the selector valve control circuit 170, the motor control circuit 171, the closing valve control circuit 172, the heater control circuit 173 and the overflow indication circuit 167.

Accordingly, the selector valve control circuit 170 switches the selector valve 138 so as to permit the intake pipe 134 to communicate with the suction pipe 136, while the intake pipe 155 does not communicate with the suction pipe 136. The motor control circuit 171 does not operate the motor 60 and the air blower 135 so that the drying cauldron 31 is not rotated, while the air blower 135 does not supply air to the air discharge pipe 137. The raw sewage introduction valve 81 is closed by the closing valve control circuit 172, and the closing valves 144, 148, 151 are also closed, while the closing valve 140 alone is opened. The heater control circuit 173 does not supply power to the heater 142 and the high-frequency coil 98 so that the heater 142 does not generate heat and the high-frequency coil 98 does not generate the electromagnet wave.

The temporary toilet 11 is set to be in a standby condition by starting the disposal apparatus 15 accommodated in the temporary toilet 11 so as to immediately dispose of the raw sewage discharged by the user when the temporary toilet 11 is temporarily used at events such as construction sites or festivals where it is installed. To set the disposal apparatus 15 in the standby condition, an administrator of the temporary toilet 11 or a staff in charge of the events turns on the power switch 166 (by supplying power).

When the power switch 166 is turned on to start the operation of the disposal apparatus 15, the power switch 166 issues a signal representing transition to the standby condition which is supplied to the CPU 165. The CPU 165 supplies, upon reception of this signal, this signal to the motor control circuit 171 and the heater control circuit 173 so as to operate the motor control circuit 171 and the heater control circuit 173 so that they are in a standby condition (this signal is not supplied from the CPU 165 to the selector valve control circuit 170 and the closing valve control circuit 172 while the selector valve 138, the raw sewage introduction valve 81 and the closing valves 140, 144, 148, 151 maintain the stop condition as mentioned above). Accordingly, the motor control circuit 171 supplies a high-frequency power to the air blower 135 so as to rotate the air blower 135 at high speed, while the heater control circuit 173 supplies power to the heater 142 so that the heater 142 generates heat.

When the air blower 135 operates, air is sucked from the suction pipe 136 and is supplied under pressure toward the air discharge pipe 137 in a direction denoted at an arrow D (hereinafter referred to D direction). The intake pipe 134 and the suction pipe 136 are connected to the selector valve 138, ambient atmosphere is sucked into a direction denoted at an arrow E (hereinafter referred to E direction) through the opening of the filter box 132 so that dust in the air is removed when it passes through the filter 133. The cleaned air passes through the air suction pipe 101 and thereafter enters the coil container 95. The air which entered the coil container 95 flows through the air discharge pipe 102 and the intake pipe 134 in a direction denoted at an arrow C (hereinafter referred to C direction), and successively passes through the selector valve 138 and the suction pipe 136, and finally it is sucked by the air blower 135.

The air compressed by the air blower 135 flows through the air discharge pipe 137 in the D direction. Most of the air flowing through the air discharge pipe 137 is directed toward the ejector 112, but a part of the air flowing through the air discharge pipe 137 is branched off to flow toward the bypass pipe 139. The bypass pipe 139 is connected to the middle of the air discharge pipe 137. When the air flows inside the ejector 112, the air passes through the throttle center of the ejector 112 at high speed, and it is discharged from a distal end of the ejector 112 in a direction denoted at an arrow F (hereinafter referred to F direction), and it is finally dispersed in the atmosphere. Since the center of the ejector 112 is throttled in its inner diameter, the air passes through the throttled portion at high speed to thereby generate a negative pressure. Air in the deodorizing box 110 is sucked by such a negative pressure, and the sucked air is mixed with the air flowing through the air discharge pipe 137, and the mixed air is discharged in the E direction.

The air which entered the bypass pipe 139 branched off from the air discharge pipe 137 passes through the closing valve 140, and thereafter it enters an inside of the reheating box 141. The heater 142 provided inside the reheating box 141 receives power from the heater control circuit 173 and it generates heat. Accordingly, the air which entered the reheating box 141 is heated when contacting the heater 142, and it is warmed at high temperature, then it is directed toward the hot-air pipe 143. The warmed air flows from the hot-air pipe 143 toward the air exhaust pipe 111, and then enters an inside of the deodorizing box 110. When the air flows inside the deodorizing box 110, it first passes through the filter 113 so that impurities such as dust contained in the air is removed, and the cleaned air flows toward the catalyst 114.

When the warmed air passes through the catalyst 114, comprising two units, each unit of the catalyst 114 is subjected to heat exchange by the warmed air, whereby each unit is heated at such a sufficient temperature that it performs oxidation-reduction. The reason why the catalyst 114 is heated by the warmed air is that the catalyst 114 cannot perform the oxidation-reduction in a normal temperature due to its inherent property, and it must be maintained at a specific temperature for performing its inherent function. The air passed through the catalyst 114 flows toward the center of the ejector 112. The central throttled portion of the ejector 112 is negatively pressurized since the air flows at high speed. The air passed through the catalyst 114 inside the deodorizing box 110 is sucked by the ejector 112, and it is mixed with the air flowing through the air discharge pipe 137 inside the ejector 112, and the mixed air is discharged toward the ambient atmosphere.

As mentioned above, each mechanism of the disposal apparatus 15 is set in an initial condition when the power switch 166 is turned on so that the disposal apparatus 15 is in a condition where the raw sewage discharged by the user can be disposed of whenever the temporary toilet 11 is used by the user, and this condition shifts to the standby condition.

The air flows in the flow route when the air blower 135 is driven as mentioned above, and at the same time, the catalyst 114 is warmed when the heater 142 generates heat so that the disposal apparatus 15 is kept in a condition where the disposal apparatus 15 can be used any time. However, when the disposal apparatus 15 is in a condition where each catalyst 114 is heated so as to perform its function so that the user can use the temporary toilet 11, the disposal apparatus 15 is automatically changed to the standby condition for saving energy. The reason is that after the catalyst 114 is heated at such a sufficient temperature that it performs its function, further heating of the catalyst 114 at a temperature exceeding such a sufficient temperature consumes power uselessly. That is, even in the condition where each mechanism is operated so that the temporary toilet 11 can be used by the user any time, it is uncertain when the temporary toilet 11 can be used. Accordingly, the disposal apparatus 15 shifts to the standby condition for reducing consumption of power when the power switch 166 is turned on and a given time elapses so that the catalyst 114 is heated to such a sufficient temperature that it performs its function.

When the CPU 165 supplies the control signal to the motor control circuit 171 and the heater control circuit 173 so as to operate them and a given time elapses, it supplies the control signal to the motor control circuit 171. The motor control circuit 171 reduces frequency of the power to be supplied to the air blower 135, upon reception of the control signal, and thereafter it rotates the air blower 135 at low speed, and thereafter reduces amount of air to be supplied to the air discharge pipe 137. When the amount of air to be supplied to the air discharge pipe 137 is reduced, amount of air to be supplied to the air discharge pipe 137 and the bypass pipe 139 is reduced so that amount of air to flow inside the deodorizing box 110 is reduced. As a result, the catalyst 114 reduces power to be consumed by the disposal apparatus 15 while the catalyst 114 maintains the sufficient temperature so as to perform its function, so that the disposal apparatus 15 maintains the standby condition.

As mentioned above, when the power switch 166 is turned on, each mechanism of the disposal apparatus 15 is in the standby condition so that the temporary toilet 11 can be used by the user any time. When using the temporary toilet 11 in the standby condition, the user opens the door 14 and enters the house 13 and discharges the raw sewage toward the stool 16. The raw sewage discharged by the user flows into the introduction pipe 82 from the lower portion of the stool 16 and is temporarily stored in the lower portion of the stool 16, which is the upper portion of the closed raw sewage introduction valve 81, and the introduction pipe 82.

The user who discharged the raw sewage toward the stool 16 must flow the raw sewage into the disposal apparatus 15 so as to remove the raw sewage stored in the bottom of the stool 16 for a next user. This procedure starts by depressing the instruction switch 163 provided in the house 13, whereby heating and drying operations of the raw sewage by the disposal apparatus 15 start.

When the instruction switch 163 is depressed by the user, the instruction signal is supplied from the instruction switch 163 to the dry processing instruction circuit 164, and then a signal representing start of disposal of the raw sewage is supplied from the dry processing instruction circuit 164 to the CPU 165. Upon reception of this signal, the CPU 165 supplies the control signal to the closing valve control circuit 172 so as to permit the raw sewage, which is stored in the lower portion of the stool 16 and the introduction pipe 82, to introduce into the drying cauldron 31. Successively, the closing valve control circuit 172 opens the raw sewage introduction valve 81 so as to permit the raw sewage, which is stored in the lower portion of the stool 16 respectively positioned upstream relative to the raw sewage introduction valve 81, to pass therethrough. The raw sewage, which passed through the raw sewage introduction valve 81, now passes through the opening of the coupling flange 75, and then drops into the drying cauldron 31, and finally stored in the bottom of the drying cauldron 13.

If the raw sewage introduction valve 81 is opened for a predetermined time, the CPU 165 instructs the closing valve control circuit 172 to close the raw sewage introduction valve 81, because it judges that all the raw sewage stored in the stool 16 and the introduction pipe 82 are introduced into the drying cauldron 31 when a given time elapses after the raw sewage introduction valve 81 is opened. When the raw sewage introduction valve 81 is closed, the upper end opening of the drying cauldron 31 is closed by the combination of the annular flange 39, the rotary ring 38 and the fixed ring 36 and another combination of the supporting plate 34 and the covering plate 35 so that the inside of the drying cauldron 31 does not communicate at all with outside of the drying cauldron 31 (an elastic annular sealing member, not shown, is provided on the bearing 37 and interposed between the fixed ring 36 and the rotary ring 38. The gap between the fixed ring 36 and the rotary ring 38 is filled up by this sealing member, so that air does not flow in the gap). Accordingly, bad smell component generated from the raw sewage does not flow out to the outside of the drying cauldron 31, which does not give the next user unpleasant feeling.

At the time when the raw sewage is dropped from the lower portion of the stool 16, it impossible to introduce or atomize surface active agent or cleaning liquid into the stool 16 by a bubble generating device or an atomizer. When such surface active agent or cleaning liquid, etc. are introduced in bubbled state or atomized state to wet the inner wall of the stool 16, the introduction pipe 82 and the coupling flange 75, so that the raw sewage stuck to these inner valves can be discharged, and at the same time a portion where the raw sewage is liable to stick can be cleaned.

The CPU 165 automatically starts a drying process of the raw sewage which is introduced into the drying cauldron 31 in accordance with steps which are stored therein. In this drying process, the CPU 165 supplies individual control signals to the motor control circuit 171, the closing valve control circuit 172 and the heater control circuit 173 so as to instruct the drying process.

The heater control circuit 173 starts upon reception of the control signal supplied from the CPU 165, to operate the high-frequency generating circuit 174. The high-frequency generating circuit 174 generates a high-frequency power which is supplied to the high-frequency coil 98. As a result, a high-frequency electromagnet wave is generated by the high-frequency coil 98 in the coil container 95. This high-frequency electromagnet wave is leaked outside the coil container 95 and vertically alternately supplied.

The high-frequency electromagnet wave leaked out from the coil container 95 passes through the bottom portion of the drying cauldron 31 close to the coil container 95, and it supplies to the bottom portion of the drying cauldron 31. Accordingly, electromagnetic induction heating occurs in the drying cauldron 31 due to the alternation of the high-frequency electromagnet wave (the drying cauldron 31 is made of a metallic material as much as iron), so that the drying cauldron 31 per se generates heat. At the same time, the high-frequency electromagnet wave is supplied to the heat holding balls 44 in the drying cauldron 31, so that the heat holding balls 44 per se generates heat. As a result of generation of heat, the raw sewage as stored in the drying cauldron 31 is heated by the heat of the drying cauldron 31 and the heat of the heat holding balls 44, so that the temperature of the raw sewage increases.

When the high-frequency power is supplied to the high-frequency coil 98, the unit of the high-frequency coil 98 per se generates heat by radiant heat from the drying cauldron 31 which generated heat. However, since the air blower 135 is already operated, the air sucked from the atmosphere passes through the filter box 132, the air suction pipe 101 and then passes in the coil container 95. Accordingly, the air cools the high-frequency coil 98 when it passes through the coil container 95, and at the same time, it is warmed by heat exchange so that the warmed air passes through the air discharge pipe 102, the intake pipe 134, then it flows in the C direction, and finally it becomes a part of heat for heating the catalyst 114 and the drying cauldron 31.

The motor control circuit 171 rotates the air blower 135, which is rotated at low speed, at high speed when it receives the control signal from the CPU 165, so that amount of air to be supplied under pressure from the air blower 135 to the air discharge pipe 137 is increased. Increase of amount of air corresponds to increase of consumption of air involved in generation of heat by the drying cauldron 31 from the standby condition to perform the drying processing. A large amount of air which flows from the air blower 135 toward the air discharge pipe 137 in the D direction in FIG. 14 generates the negative pressure when it passes through the ejector 112 so as to strongly suck air in the deodorizing box 110. This large amount of air, which is larger than the amount of air in the standby condition also flows towards the bypass pipe 139, and is heated by the heater 142 to such an extent that it can warm the catalyst 114 so as to permit the catalyst 114 to perform its function.

The closing valve control circuit 172 opens, upon reception of the control signal which is supplied from the CPU 165 to the closing valve control circuit 172, the closing valves 144 and 148 while keeping the closing valve 140 open. The air route is partially changed when the closing valves 144 and 148 are opened. Although the air from the air blower 135 is directed after it passes through the air discharge pipe 137 and the ejector 112, a part of the air passes through the ejector 112 enters the auxiliary pipe 147 from the air introduction port 146 and then it passes through the opened closing valve 148 and finally enters into the inner space of the drying cauldron 31 through the introduction hole 77 since the air introduction port 146 in the ejector 112 is directed toward the wind. In such a manner, a fresh air which entered from the air introduction port 146 is supplied to the drying cauldron 31 through the introduction hole 77, so that oxidation of the raw sewage, which is warmed in the heated drying cauldron 31 and evaporated in its liquid component, is expedited.

When the closing valve 144 is opened, the air in the drying cauldron 31 passes through the discharge hole 78, and flows in the closing valve 144 and the air discharge pipe 145, and then enters the air exhaust pipe 111. As mentioned above, since the air which passed through the ejector 112 generates the negative pressure to suck the air in the deodorizing box 110, the evaporated vapor and the air in the drying cauldron 31 is also sucked through the air discharge pipe 145, and the former and latter air are mixed with each other in the ejector 112, and finally they are discharged toward the atmosphere in the F direction.

When the drying cauldron 31 is heated by the high-frequency electromagnet wave from the high-frequency coil 98, the raw sewage, which is stored in the drying cauldron 31, is boiled, and liquid component which is primary component thereof is evaporated as vapor. The vapor flows in the direction of the discharge hole 78 and the air discharge pipe 145 together with the air. However, since the air which flows out from the drying cauldron 31 includes ammonia, urea, etc. which cause bad smell in the raw sewage, it diffuses bad smell around the temporary toilet 11 if it is discharged from the temporary toilet 11 as it is. Accordingly, it is undesirable to diffuse the air to the atmosphere unless the bad smell component is removed.

The vapor and air including bad smell component, which flows from the drying cauldron 31 toward the air discharge pipe 145, flows through the air exhaust pipe 111, then enter the deodorizing box 110. Since the air in the deodorizing box 110 is sucked by the ejector 112, the vapor and air from the drying cauldron 31 enters the deodorizing box 110 as they are. They pass through the filter 113 where dust, etc. are removed in the filter 113, and contact the catalyst 114 comprising two units which are disposed in two stages. Since the two units of the catalyst 114 are heated to a sufficient temperature that they can perform their function owing to the air warmed by the heater 142 from the standby condition, the vapor and air from the drying cauldron 31 including the bad smell component contact the catalyst 114, whereby they are subjected to oxidation-reduction. That is, when the bad smell component such as ammonia, urea, etc. contact the catalyst 114, it is subjected to oxidation-reduction so that they are changed into an odorless component. The odorless vapor and air is sucked by the ejector 112 and they are diffused in the atmosphere in the F direction. Under the circumstances, the bad smell does not escape around the temporary toilet 11 since the raw sewage is evaporated inside the drying cauldron 31 so that the temporary toilet 11 can be used comfortably.

At the same time when the motor control circuit 171 controls the air blower 135 so as to operate it at high speed, it starts the operation of the motor 60. When the motor 60 is operated, the motor shaft 62 of the motor 60 is rotated so that the small gear 66 fixed to the motor shaft 62 is driven. When the small gear 66 is rotated, the rotary ring 38 which meshes with the circumference of the small gear 66 is rotated, so that the rotary ring 38 is rotated horizontally about the center of the fixed ring 36. Since a series of bearings are interposed between the rotary ring 38 and the fixed ring 36, the rotary ring 38 can be smoothly rotated about the central axis of the fixed ring 36 as its rotary shaft core.

Since the annular flange 39 and the drying cauldron 31 are hung by the lower surface of the rotary ring 38, the drying cauldron 31 can be horizontally rotated at the same rotating speed as that of the rotary ring 38 when the rotary ring 38 is rotated. Since the drying cauldron 31 is still hung by the rotary ring 38 and the annular flange 39, it can be rotated without being vibrated vertically and horizontally while it is positioned vertically in its central axis. Accordingly, a slight gap is maintained between the lower surface of the drying cauldron 31 and the upper surface of the covering plate 97 of the coil container 95, so that the lower surface of the drying cauldron 31 does not contact the upper surface of the covering plate 97 even if the drying cauldron 31 is rotated.

When the drying cauldron 31 is rotated by the motor 60, the heat holding balls 44 accommodated in the drying cauldron 31 are also rotated in the rotating direction of the drying cauldron 31. However, when the heat holding balls 44 are rotated, the heat holding balls 44 contact the stirring plate 89 of the baffle plate 88, which is fixed in the internal space of the drying cauldron 31 while it is hung (since the baffle plate 88 is fixed to the lower surface of the suction pipe 85 and the upper end of the suction pipe 85 is fixed to the covering plate 35, the baffle plate 88 and the stirring plate 89 are not rotate together with the drying cauldron 31). Since the baffle plate 88 and the stirring plate 89 are fixed irrespective of the rotation of the drying cauldron 31, when the heat holding balls 44 contact the stirring plate 89, the heat holding balls 44 are stopped in their rotation at the portion where they contact the stirring plate 89. As a result, even if the drying cauldron 31 is still rotated the heat holding balls 44 are obstructed in their rotation.

The raw sewage which is stored in the drying cauldron 31 is rotated with the rotation of the drying cauldron 31 as shown in FIG. 7. However, when the heat holding balls 44, which are stopped in the rotation by the stirring plate 89, contact the bottom surface of the drying cauldron 31, they per se are rolled to thereby stir the raw sewage while they are rolled in the rotating raw sewage. When the heat holding balls 44 are rolled to stir the raw sewage, they per se generate heat which is transmitted to the raw sewage. Accordingly, the raw sewage is mixed so that temperature of the entire raw sewage becomes uniform while it is stirred by the heat holding balls 44, the baffle plate 88 and the stirring plate 89, so that the temperature of the entire raw sewage is increased.

The projection 45 rises on the central bottom portion of the drying cauldron 31 as shown in the cross-sectional view of FIG. 5. Since the projection 45 is positioned at the center of the drying cauldron 31, even if the heat holding balls 44 are rolled by the rotation of the drying cauldron 31, the heat holding balls 44 are not localized at the center of the drying cauldron 31 but they are moved at the periphery of the drying cauldron 31 which is a foot of the projection 45. Accordingly, the heat holding balls 44 are always rolled at the periphery of the bottom portion of the drying cauldron 31 so as to surely stir the raw sewage.

The drying cauldron 31 is rotated by the operation of the motor 60 by way of the motor shaft 62, the small gear 66, the rotary ring 38 and the annular flange 39. However, the rotating direction of the drying cauldron 31 is not always fixed to one direction. That is, the drying cauldron 31 is rotated in a forward direction for a given time then it is rotated in a reverse direction. Since the drying cauldron 31 is rotated alternately in one direction or the reverse direction, the motor control circuit 171 operates the motor 60 alternately in the normal or reverse direction every predetermined given time. In such a manner, when the drying cauldron 31 is normally rotate or reversely rotated alternately, the raw sewage stored in the drying cauldron 31 is controlled not to localize in a specific position in the drying cauldron 31. Further, when the drying cauldron 31 is normally rotated or reversely rotated every fixed time, the raw sewage can be mixed while the temperature thereof is made uniform.

Each mechanism of the disposal apparatus 15 is operated under the control of the CPU 165. That is, the high-frequency coil 98 generates the high-frequency electromagnet wave, and the drying cauldron 31 is normally rotated or reversely rotated alternately by the operation of the motor 60 and the air is supplied to the drying cauldron 31. In such an operation of each mechanism, the primary component of the raw sewage stored in the drying cauldron 31 is changed to vapor and is evaporated, and the evaporated vapor is diffused in the atmosphere through the ejector 112. With continuous operations, the raw sewage stored in the drying cauldron 31 is reduced in its capacity, and finally a solid substance such as paper, fibrous substances which are not evaporated, remains in the drying cauldron 31.

When the heating and drying process starts by the disposal apparatus 15, the disposal apparatus 15 automatically subjects the raw sewage to heating and evaporating process. In this case, if the speed of the heating and evaporating of the raw sewage is balanced with the amount of the raw sewage discharged into the stool 16, there does not occur any problem in the aforementioned process, so that the disposal apparatus 15 can perform continuously the processes.

However, if the temporary toilet 11 can be used any time, there is a likelihood that the number of users using the temporary toilet 11 is temporarily increased. If many users use the temporary toilet 11 in a short time, the amount of the raw sewage to be discharged into the stool 16 is increased, and hence the amount of the raw sewage to be introduced into the drying cauldron 31 through the coupling flange 75 by way of the introduction pipe 82 and the raw sewage introduction valve 81 is increased. Accordingly, the raw sewage exceeding the capacity of evaporation thereof by the drying cauldron 31 is introduced, and hence the amount of the raw sewage to be introduced, and hence finally, the amount of the raw sewage to be stored in the drying cauldron 31 becomes greater than the capacity of the drying cauldron 31. In such a case, namely, when the raw sewage overflows from the drying cauldron 31, normal evaporating process cannot be performed and the trouble caused by overflow could occur. Such an overflow of the raw sewage must be prevented in advance. The disposal apparatus 15 has a function to automatically detect overflow of the raw sewage when the amount of raw sewage to be introduced into the drying cauldron 31 exceed the processing capacity of the drying cauldron 31, and also to permit the raw sewage corresponding to the processing capacity to be introduced into the drying cauldron 31.

Every time when the user enters the temporary toilet 11 and discharges the raw sewage into the stool 16, he depresses the instruction switch 163 so as to open the raw sewage introduction valve 81 to permit the discharged raw sewage to be introduced into the drying cauldron 31. The discharged raw sewage is successively accumulated, and the thus accumulated raw sewage increases in its liquid level. The liquid level reaches at last the lower end of the liquid level sensors 158, which permits the liquid level sensors 158 to be electrically conductive. The liquid level sensors 158 issue the conductive (short-circuited) signal which is supplied to the overflow discrimination circuit 161. The overflow discrimination circuit 161, upon reception of this signal, judges that the raw sewage exceeds the processing capacity and issues a discrimination signal, which is supplied to the CPU 165.

The CPU 165 controls, upon reception of the discrimination signal from the overflow discrimination circuit 161, so as to temporarily restrict the use of the temporary toilet 11 to prevent overflow. First, the CPU 165 supplies a signal to the overflow indication circuit 167 so as to light the indication lamp 168. When the indication lamp 168 is lighted in the house 13 (e.g. a red warning light), a next user intending to use the temporary toilet 11 identifies that the temporary toilet 11 is in a non-use condition.

At the same time, the CPU 165 interrupts the transmission of a signal between the dry processing instruction circuit 164 and the closing valve control circuit 172 so that the CPU 165 does not supply the control signal to the closing valve control circuit 172 even if the signal to dispose of the discharged raw sewage is issued from the dry processing instruction circuit 164 when the user depresses the instruction switch 163. Accordingly, even if the user depresses the instruction switch 163 after the use of the temporary toilet 11, the closing valve control circuit 172 does not open the raw sewage introduction valve 81 so that the raw sewage is stored between the lower portion of the stool 16 and the introduction pipe 82 so that it is not introduced into the drying cauldron 31.

In such a manner, if the raw sewage is stored in the bottom of the stool 16, the next user, who intends to use the temporary toilet 11, knows the restriction of use of the temporary toilet 11 because the raw sewage is stored in the bottom of the stool 16, and stops use of the temporary toilet 11. The CPU 165 maintains the closing of the raw sewage introduction valve 81 forcibly until one cycle when the cleaning of the drying cauldron 31 is terminated after all the raw sewage introduced into the drying cauldron 31 is subjected to evaporating process.

In the disposal apparatus 15, the drying cauldron 31 is heated by a high-frequency electromagnetic wave and liquid component which is a primary component of the raw sewage stored in the drying cauldron 31 is successively evaporated and diffused toward the ambient atmosphere. (During the evaporating/drying process, the drying cauldron 31 is rotated while it is continuously reversely rotated by the motor 60.) When the evaporating/drying process continue, all the liquid components in the drying cauldron 31 are evaporated, residual substances such as fibrous substances and ashes remain in the drying cauldron 31. When all the liquid components of the raw sewage are evaporated is a time of completion of the evaporating/drying process, which is automatically detected and next process starts.

When all the liquid components are evaporated owing to the evaporating/drying process of the raw sewage by the heating of the drying cauldron 31, entire temperature of the drying cauldron 31 rises abruptly, which leads to the judgement of termination of the evaporating/drying process. That is, the temperature sensor 91, which is fixed to one side of the reinforcing bodies 87 provided at the rear surface of the baffle plate 88, always detects the temperature change of the drying cauldron 31 (especially a portion adjacent to the bottom thereof), and converts the temperature into an electric signal which is supplied to the temperature discrimination circuit 162. The temperature discrimination circuit 162 receives the temperature detected signal from the temperature sensor 91, and does not output any signal when the drying cauldron 31 maintains a low temperature at which the drying cauldron 31 performs the evaporating/drying process. However, if the low temperature is changed to a high temperature when all the liquid component contained in the raw sewage is evaporated, the temperature discrimination circuit 162 discriminates the change of temperature and supplies the change of temperature as a detecting signal representing the termination of the evaporating/drying process to the CPU 165. The CPU 165 judges, upon reception of the signal from the temperature discrimination circuit 162, that the evaporating/drying process by the drying cauldron 31 is terminated, and it transits to the next step.

That is, the CPU 165 outputs the signal to the heater control circuit 173 so as to stop the power to the heater 142 and also stop the operation of the high-frequency generating circuit 174 so that the supply of the high-frequency power to the high-frequency coil 98 is stopped. Accordingly, the high-frequency electromagnetic wave is not generated by the high-frequency coil 98 so that the drying cauldron 31 is not heated by the electromagnetic wave. At this time, since the signal to the motor control circuit 171 is not changed, the motor 60, the air blower 135 are continuously driven so that the drying cauldron 31 is still rotated and air is supplied to the ejector 112.

When the liquid component of the raw sewage in the drying cauldron 31 is evaporated, residual substances such as fibrous substances and ashes, which cannot be evaporated, remain in the drying cauldron 31, and these residual substances are accumulated every evaporating/ drying process. When the dust is accumulated every evaporating/ drying process, it is accumulated on the bottom of the drying cauldron 31, which deteriorates the thermal transmission efficiency and also obstructs the rotary motion of the drying cauldron 31. Accordingly, the drying cauldron 31 is subjected to the cleaning process every termination of the evaporating/drying process. The disposal apparatus 15 can continuously dispose of the raw sewage since the drying cauldron 31 is always subjected to cleaning process.

At the same time when the CPU 165 supplies the control signal to the heater control circuit 173, it also supplies the control signals to the selector valve control circuits 170 and the closing valve control circuit 172 so as to switch the air route in the disposal apparatus 15.

The selector valve control circuit 170 switches, upon reception of the control signal, the selector valve 138 so as to connect the intake pipe 155 to the suction pipe 136 so that the air enters from the D direction into the suction pipe 136. The closing valve control circuit 172 closes, upon reception of the control signal, the closing valves 144 and 140 and opens the closing valve 151. The air from the suction pipe 136 is supplied under pressure from the air blower 135 to the air discharge pipe 137 in the D direction and discharged from the ejector 112 toward the ambient atmosphere due to the switching and closing of each valve by the closing valve control circuit 172. However, a part of the air flows from the air introduction port 146 toward the auxiliary pipe 147, passes through the closing valve 148 and then enters the drying cauldron 31 through the introduction hole 77. The air sucked from the lower end opening of the suction pipe 85 flows in the order of the air introduction pipe 76, the air discharge pipe 150, the closing valve 151, the dust pipe 152 and the dust collecting box 153, then it passes through the intake pipe 155 and the selector valve 138, and thereafter it returns to the suction pipe 136 of the air blower 135. That is, the air supplied under pressure from the air blower 135 is circulated in a closed circuit through which air passes the ejector 112, the drying cauldron 31 and the dust collecting box 153 by the switching of the air route.

When the air route is changed, the closing valve 140 is closed so that the air does not flow from the air discharge pipe 137 to the bypass pipe 139 and all the air flows toward the ejector 112. As a result, the amount of air to be caught by the air introduction port 146 becomes larger than the amount of air in the air route at the time of evaporating/ drying process. Accordingly, the amount of air, which passes through the auxiliary pipe 147 and enters the drying cauldron 31, becomes large, which generates such an effect that the dust is dispersed in the drying cauldron 31 so as to effectively perform the suction of the dust by the suction pipe 85.

In such a manner, the air including the dust remaining in the drying cauldron 31 is sucked from the lower end opening of the suction pipe 85, and this air passes through the air introduction pipe 76, the air discharge pipe 150, and the closing valve 151, and then it enters the dust bag 154 which is connected to the distal end opening of the dust pipe 152. As mentioned above, the baggy dust bag 154 is accommodated inside the dust collecting box 153, and the air including the dust, which is discharged from the dust pipe 152, does not enter the inner space of the dust collecting box 153 but enters the dust bag 154. The dust bag 154 is made of paper, cloth, etc., which has a characteristic to permit the air to flow therethrough but permit the solid substance such as dust to be caught by a film surface thereof. Fine dust contained in the air, which entered from the dust pipe 152, is caught by the dust bag 154. Clean air, which is separated from the dust, passes through the film surface of the dust bag 154, then moves into the inner space of the dust collecting box 153, successively it passes through the intake pipe 155 and the selector valve 138, and finally it is sucked toward the air blower 135 through the suction pipe 136. The air supplied under pressure from the air blower 135 flows in the air discharge pipe 137 and it is dispersed toward the ambient atmosphere through the ejector 112.

During the removing process of the dust from the air by the suction pipe 85 in the drying cauldron 31, the CPU 165 continues the operation of the motor 60 by way of the motor control circuit 171, so that the drying cauldron 31 is still rotated by the motor 60. When the drying cauldron 31 is rotated, the heat holding balls 44 are still rotated on the bottom of the drying cauldron 31 so that the residual substances of the raw sewage, which are fixed to the inner bottom and side surfaces of the drying cauldron 31, are cut off and smashed into small pieces so that they are processed to be easily sucked together with the air. When the heat holding balls 44 are rotated, the cleaning efficiency of the drying cauldron 31 can be enhanced.

When the cleaning process of the drying cauldron 31 continues for a given time, the dust which is stored in the drying cauldron 31 is sucked and it is transferred to the dust collecting box 153 together with the air, wherein the dust is caught by the dust bag 154 in the dust collecting box 153. Finally, the dust stored in the inner bottom of the drying cauldron 31 moves inside the dust bag 154 so that the cleaning is completed. When the cleaning process is terminated, it is necessary to return to the initial condition for performing again the evaporating/drying process.

If the cleaning process of the drying cauldron 31 continues for a given time, which is set previously by a program, the CPU 165 returns each function of the disposal apparatus 15 to the initial condition for disposing of the next raw sewage unless an instruction to stop the operation of the disposal apparatus 15 is not made by the power switch 166.

First, the CPU 165 outputs the control signal to the motor control circuit 171 so as to stop the operation of the motor 60 so that the rotary motion of the drying cauldron 31 by the motor 60 is temporarily stopped. Even in the switching of each function of the disposal apparatus 15 to the initial condition, the motor control circuit 171 rotates the air blower 135 at high speed so that a large amount of air is supplied in the direction of the ejector 112 in the same way as the cleaning process of the drying cauldron 31.

At the same time when the CPU 165 supplies the control signal to the motor control circuit 171, it also supplies the control signals to the selector valve control circuits 170 and the closing valve control circuit 172 so as to return the air route in the disposal apparatus 15 to the standby condition.

The selector valve control circuit 170 switches, upon reception of the signal from the CPU 165, the selector valve 138 so as to communicate the intake pipe 134 with the suction 136. The CPU 165 supplies the control signal to the closing valve control circuit 172 so as to open the closing valve 140 and at the same time close the closing valves 148 and 151 (the closing valve 144 is already closed). Accordingly, the air from the ambient atmosphere is sucked through the opening of the filter box 132 in the E direction, and passes through the air suction pipe 101, then enters the coil container 95, successively passes through the air suction pipe 101, intake pipe 134 and selector valve 138 in the C direction, thereafter sucked toward the air blower 135 through the suction pipe 136, wherein the air is compressed by the air blower 135 and flows toward the air discharge pipe 137.

Since the bypass pipe 139 is connected to the midway of the air discharge pipe 137, a part of the air flowing through the air discharge pipe 137 is branched into the bypass pipe 139, but most of the air flows in the direction of the ejector 112. When the air under pressure enters the ejector 112, it passes through the center of the ejector 112 at high speed, and flows out in the F direction from the rear end of the ejector 112, and finally it is dispersed in the atmosphere. When the air flows inside the ejector 112, it passes through the throttled portion of the ejector 112 at high speed, which permits the periphery thereof to be negatively pressurized since the center of the ejector 112 is throttled, so as to suck the air in the ejector 112 with negative pressure. Accordingly, the negatively sucked air is mixed with the air flowing from the air discharge pipe 137, and the mixed air is dispersed in the F direction.

The air flowing from the bypass pipe 139, which is branched from the air discharge pipe 137, passes through the closing valve 140, and enters the inside of the reheating box 141. The air contacts the heated heater 142 (power is supplied to the heater 142 at the same time when the closing valves are opened or closed by the CPU 165, described later) when it passes through the reheating box 141, and it is warmed, then it flows toward the hot-air pipe 143. The warmed air flows from the hot-air pipe 143 toward the air exhaust pipe 111, then it enters the deodorizing box 110 so as to warm the catalyst 114 in the deodorizing box 110. The air passes through both units of the catalyst 114 is sucked by the ejector 112, and it is mixed with the air flowing from the air discharge pipe 137 in the ejector 112, and the mixed air is discharged toward the ambient atmosphere. This air route is the same as that in the aforementioned "preheating" and "standby" conditions.

During the cleaning process of the drying cauldron 31, the heater control circuit 173 stops the supply of power to the heater 142 so that the heater 142 does not generate heat. However, when it is operated to return to the standby condition by the CPU 165, the CPU 165 supplies the control signal to the heater control circuit 173 so that the heater control circuit 173 supplies the power to the heater 142 so the heater 142 generates heat. When the heater 142 generates heat, the air passing through the reheating box 141 is warmed, and the warmed air warms the catalyst 114 to permit the catalyst 114 to be at such a temperature that the catalyst 114 performs the oxidation-reduction. Meanwhile, even if the heater 142 generates heat, the heater control circuit 173 does not output the control signal to the high-frequency generating circuit 174 and does not supply the high-frequency power to the high-frequency coil 98 so that the drying cauldron 31 is not heated.

In such a manner, the catalyst 114 is at a sufficient temperature so as to perform its function when the air route is switched by the selector valve control circuit 170 and the closing valve control circuit 172 and the heater 142 generates heat by the heater control circuit 173, and the driving of the motor 60 is stopped by the motor control circuit 171 and thereafter a given time elapses. Thereafter, if the temporary toilet 11 is used by the next user, the raw sewage can be disposed of in the aforementioned cycles. However, if the next user does not appear, the disposal apparatus 15 transits to the standby condition to prevent the consumption of the power. That is, if a given time elapses after the preheating of the catalyst 114 is performed, the CPU 165 supplies the control signal to the motor control circuit 171 so that the motor control circuit 171 reduces the rpm of the air blower 135 so as to reduce the amount of air to be supplied from the air blower 135 in the direction of the air discharge pipe 137. The standby condition is maintained until the next user utilizing the temporary toilet 11 appears.

The raw sewage discharged toward the stool 16 by the user is continuously subjected to the evaporating/drying process by a series of cycles comprising "initial setting of each mechanism by preheating", "maintenance in the standby condition", "use of the temporary toilet 11 by the user", "introduction of the raw sewage into the drying cauldron 31", "drying operation of the raw sewage by the drying cauldron 31", "coping with overflowing of the raw sewage from the drying cauldron 31", "detection of termination of the evaporating/drying process of the raw sewage", "cleaning process of the drying cauldron 31", and "switching to the standby condition". However, in case of moving of the temporary toilet 11, stopping the use thereof at night in event place, keeping the temporary toilet 11 in the warehouse, the operation of the disposal apparatus 15 must be stopped. In such a manner, the interruption of the function of the disposal apparatus 15 is performed by turning off the power switch 166 (turning off the power supply), and a signal issued by the power switch 166 is supplied to the CPU 165 which instructs the stop of operation to each element.

That is, the CPU 165 supplies the control signal to the motor control circuit 171 so as to stop the operation of the air blower 135, and also supplies the control signal to the heater control circuit 173 so as to stop the supply of the power to the heater 142. As a result, each function of the disposal apparatus 15 is stopped. Meanwhile, even if the power switch 166 is turned off during the evaporating/drying process of the raw sewage is performed, the disposal apparatus 15 is not stopped until a series of cycles of the raw sewage disposal are terminated. The stop of the function of the disposal apparatus 15 is a condition where the power switch 166 is turned off in the previous standby condition. The reason is that when the function of the disposal apparatus 15 is stopped while the raw sewage or dust is stored in the drying cauldron 31, it is impossible to perform a next processing cycle when the disposal apparatus 15 is used again.

When the disposal apparatus 15 is again operated after the stop of operation of the disposal apparatus 15 by turning off the power switch 166, the power switch 166 is turned on so as to operate the disposal apparatus 15, whereby the temporary toilet 11 can be used.

Figure 16:
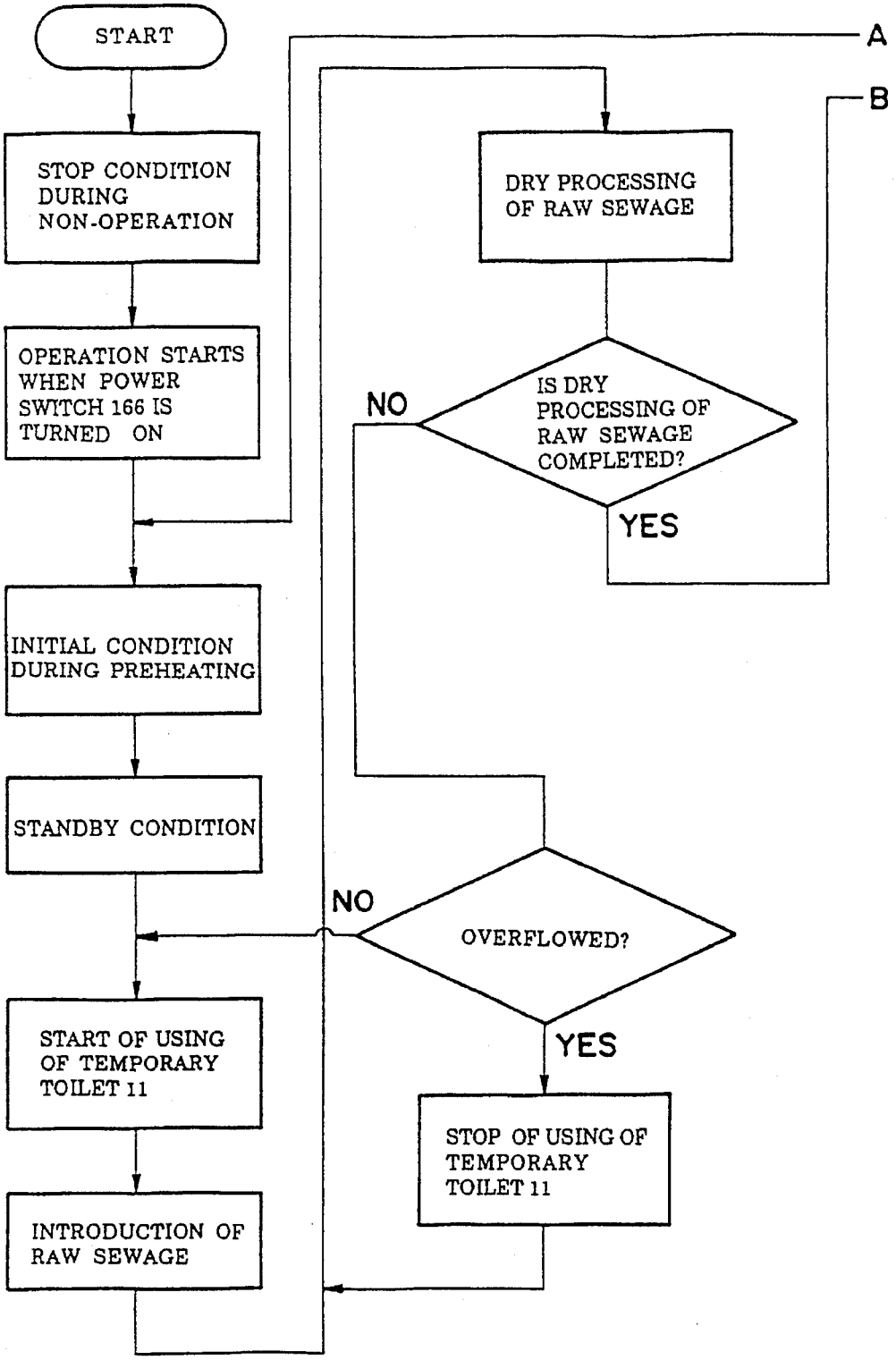
FIG. 16 is a schematic flowchart showing the operations of the raw sewage disposal apparatus.
Figure 17:
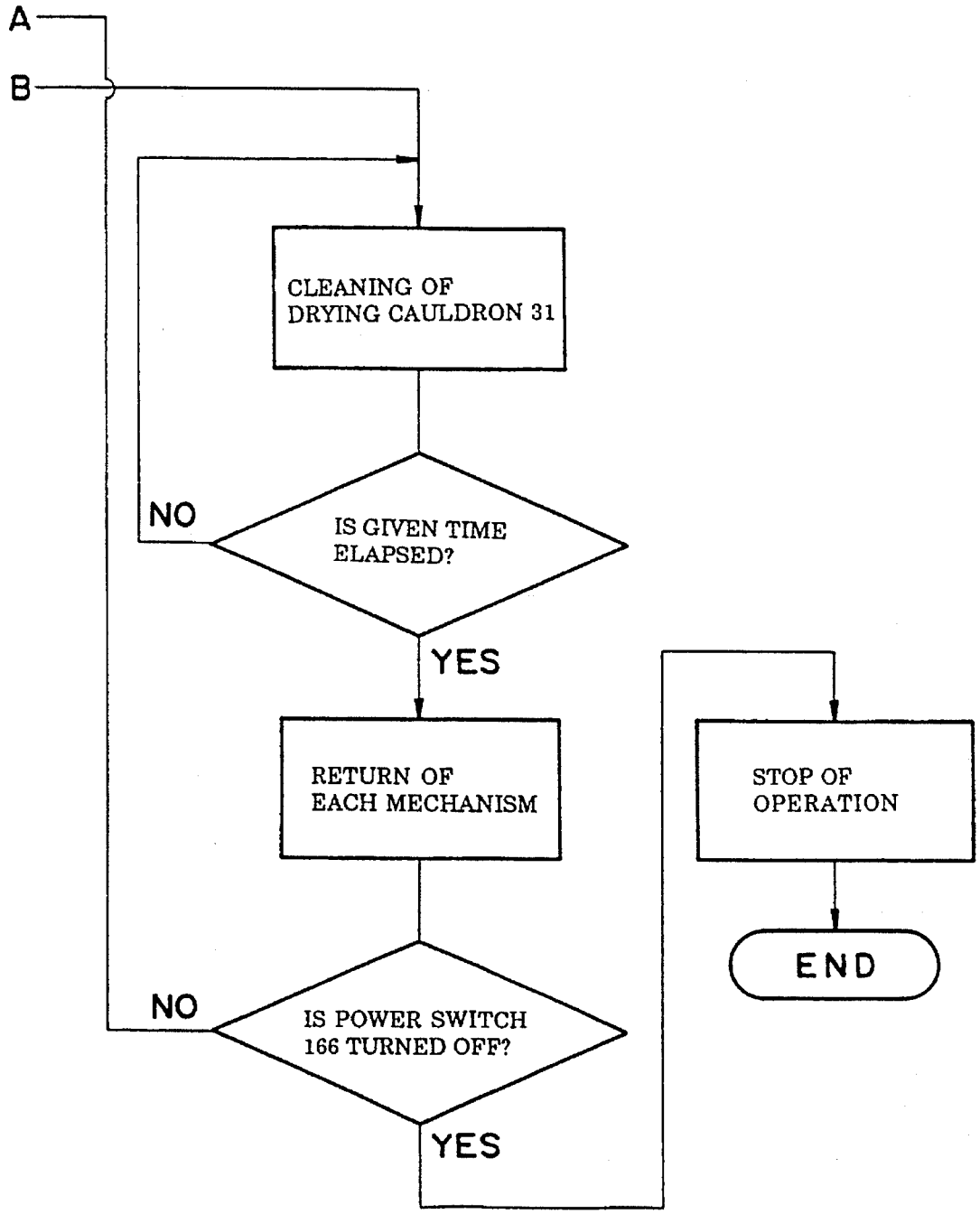
FIG. 17 is a schematic flowchart showing the operation of the raw sewage disposal apparatus.
Figure 19:
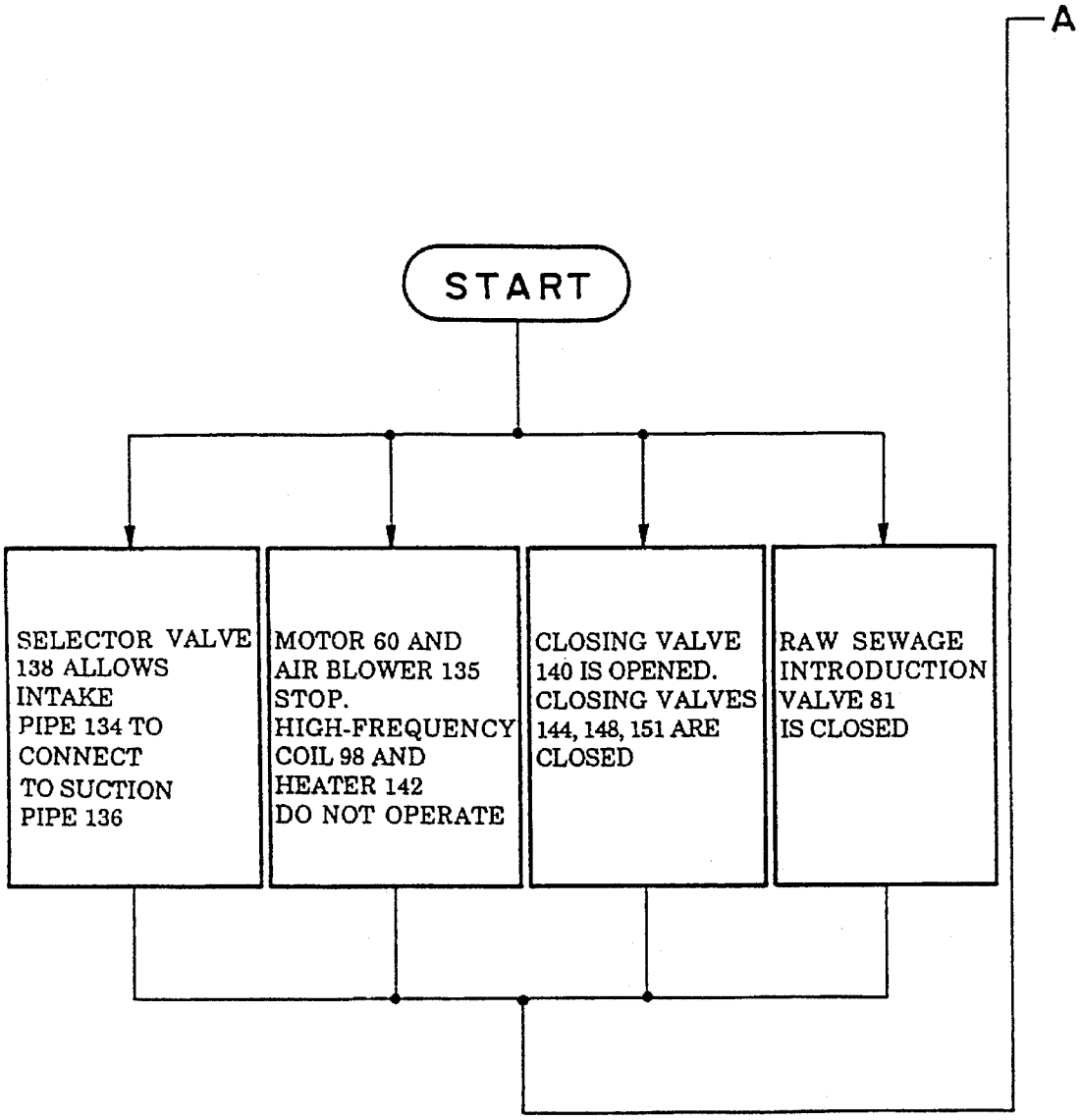
FIGS. 19 to 25 are flowcharts showing the operations of the raw sewage disposal apparatus.
Figure 20:
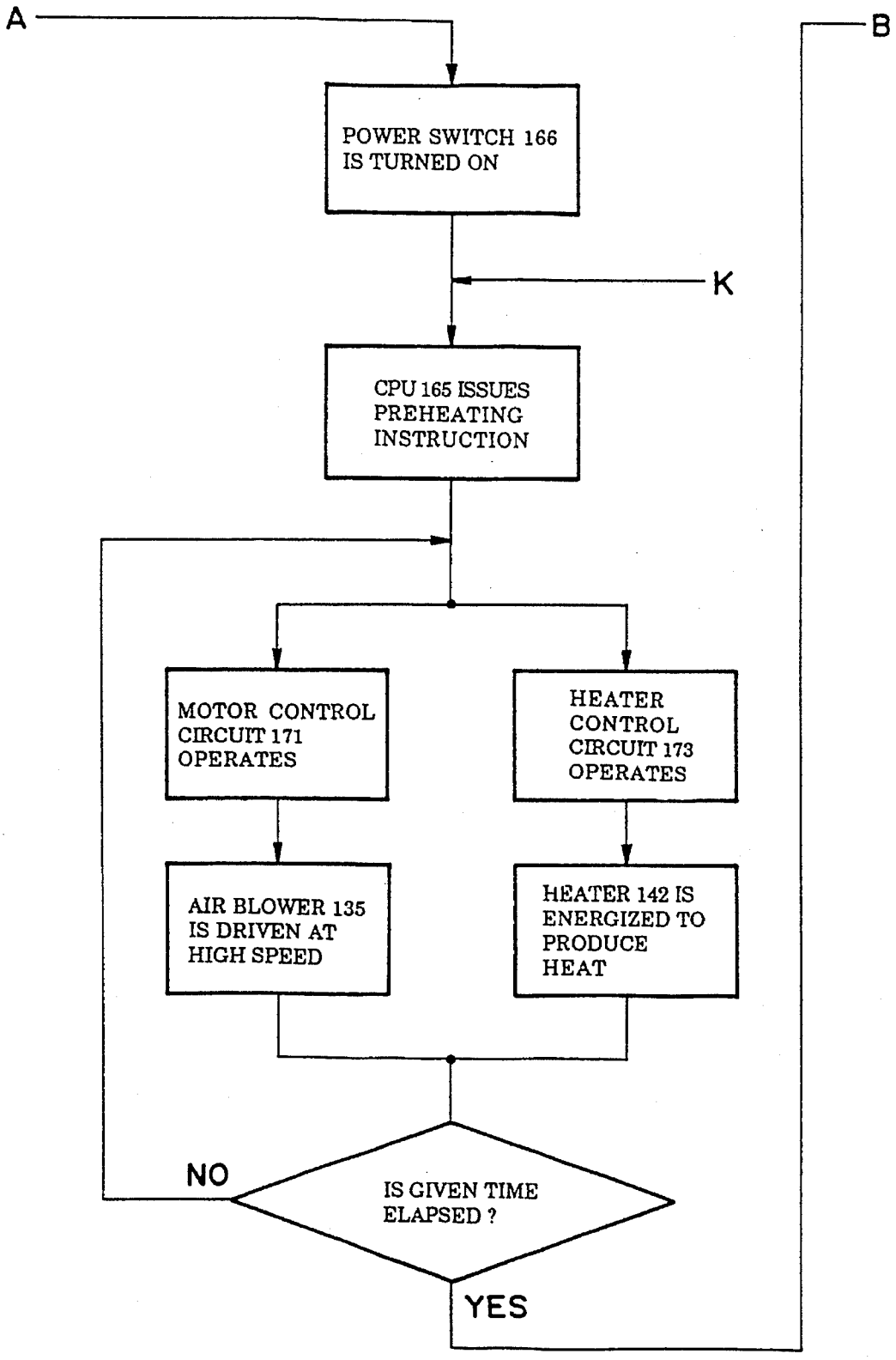
Figure 21:
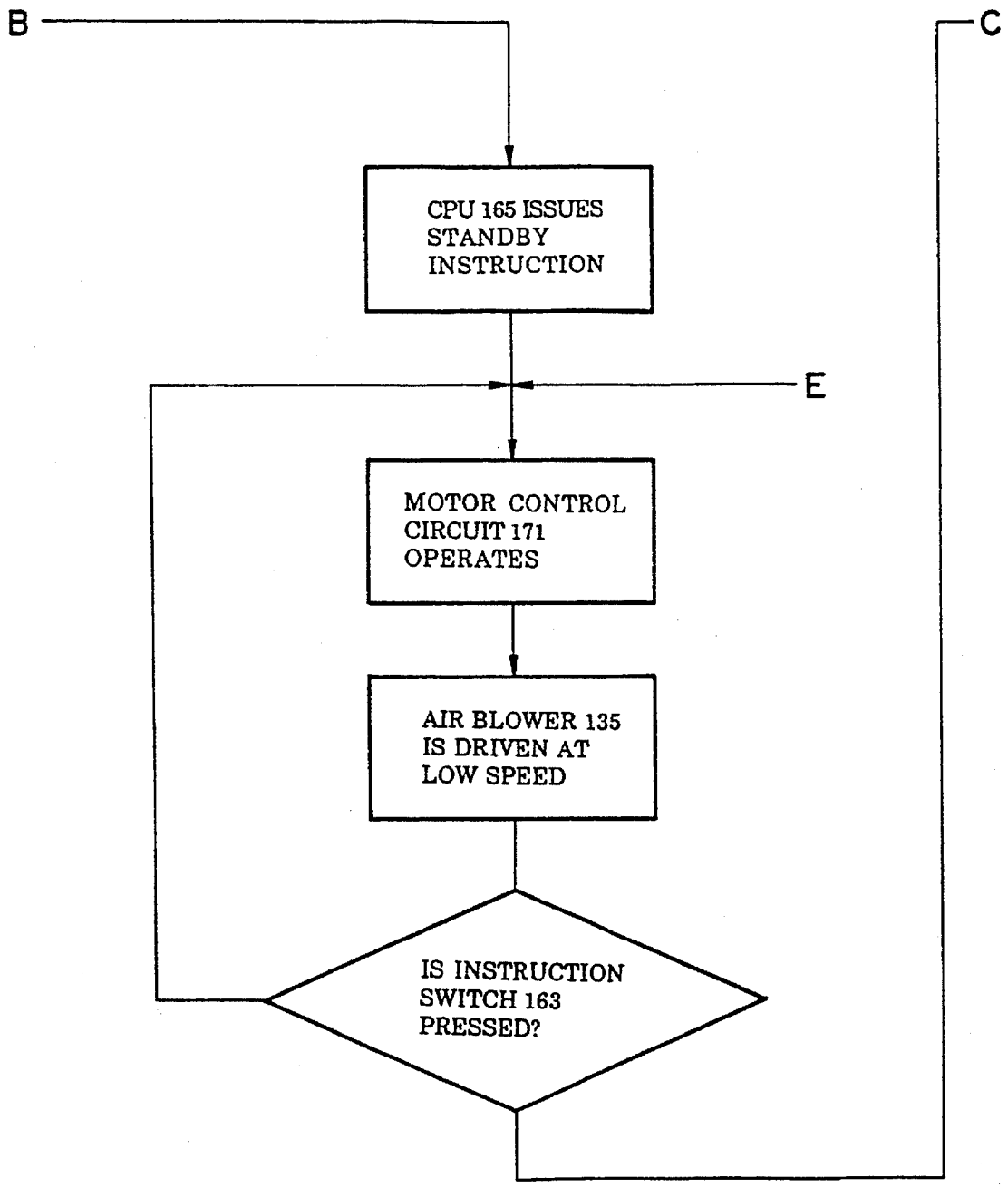
Figure 22:
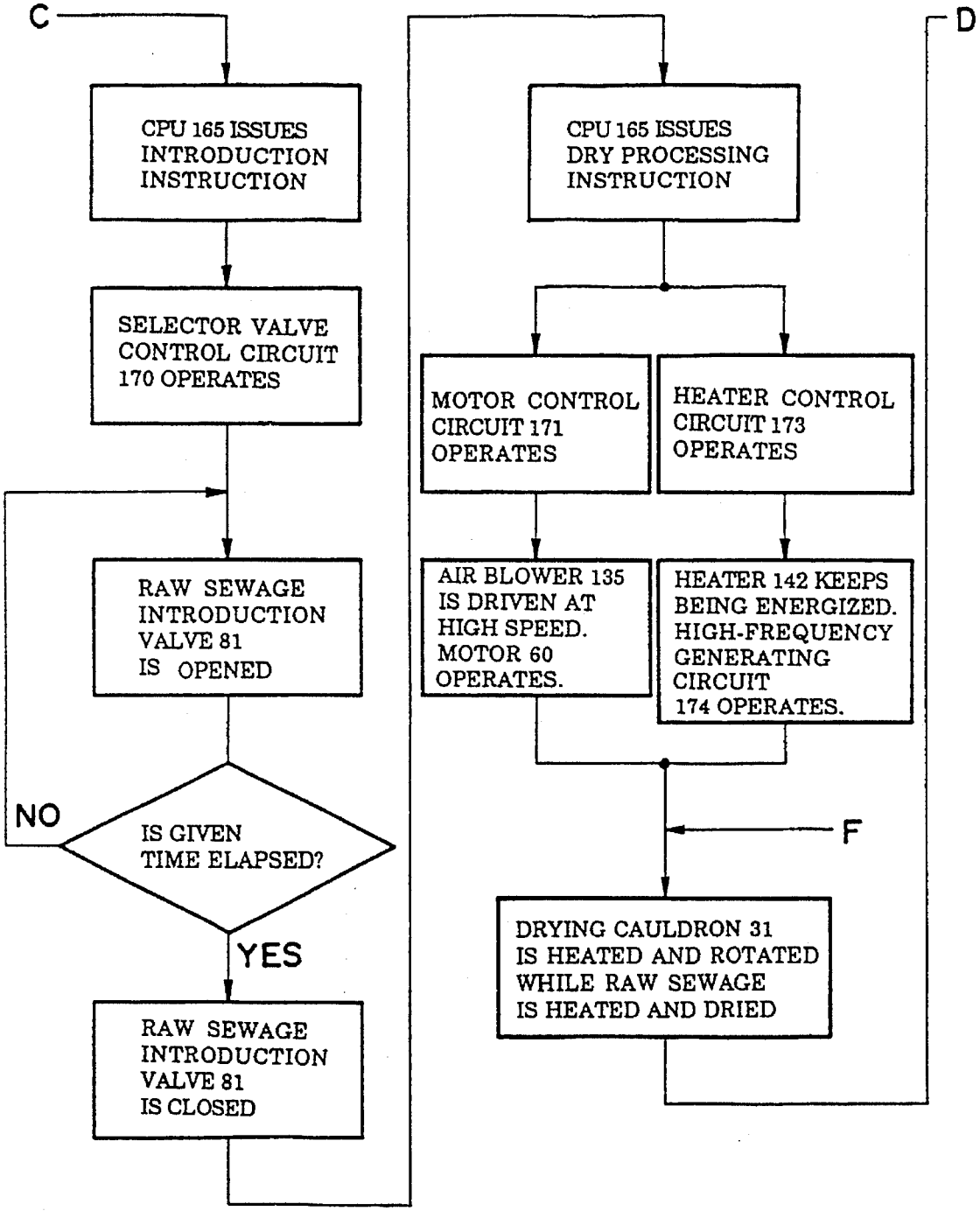
Figure 23:
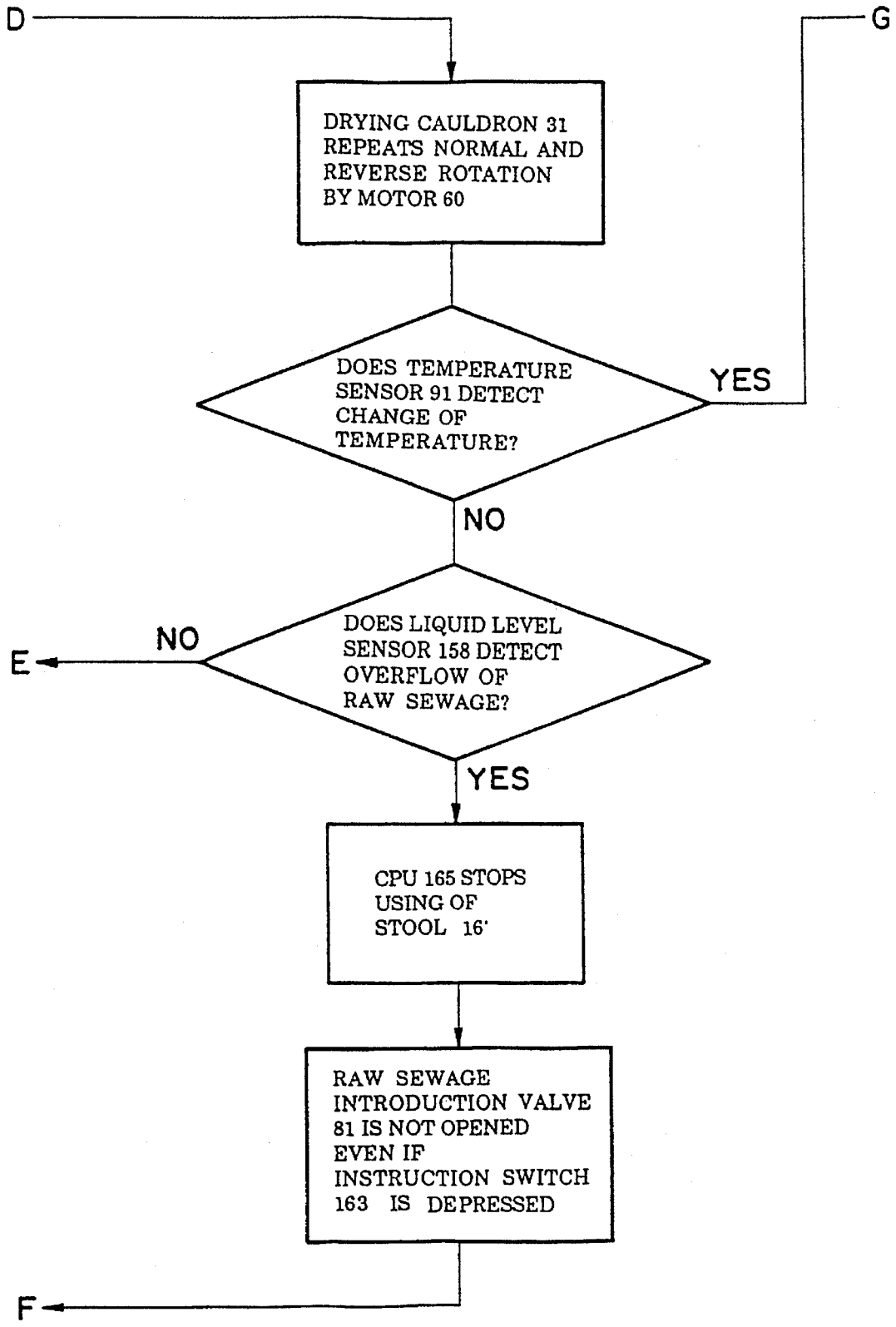
Figure 24:
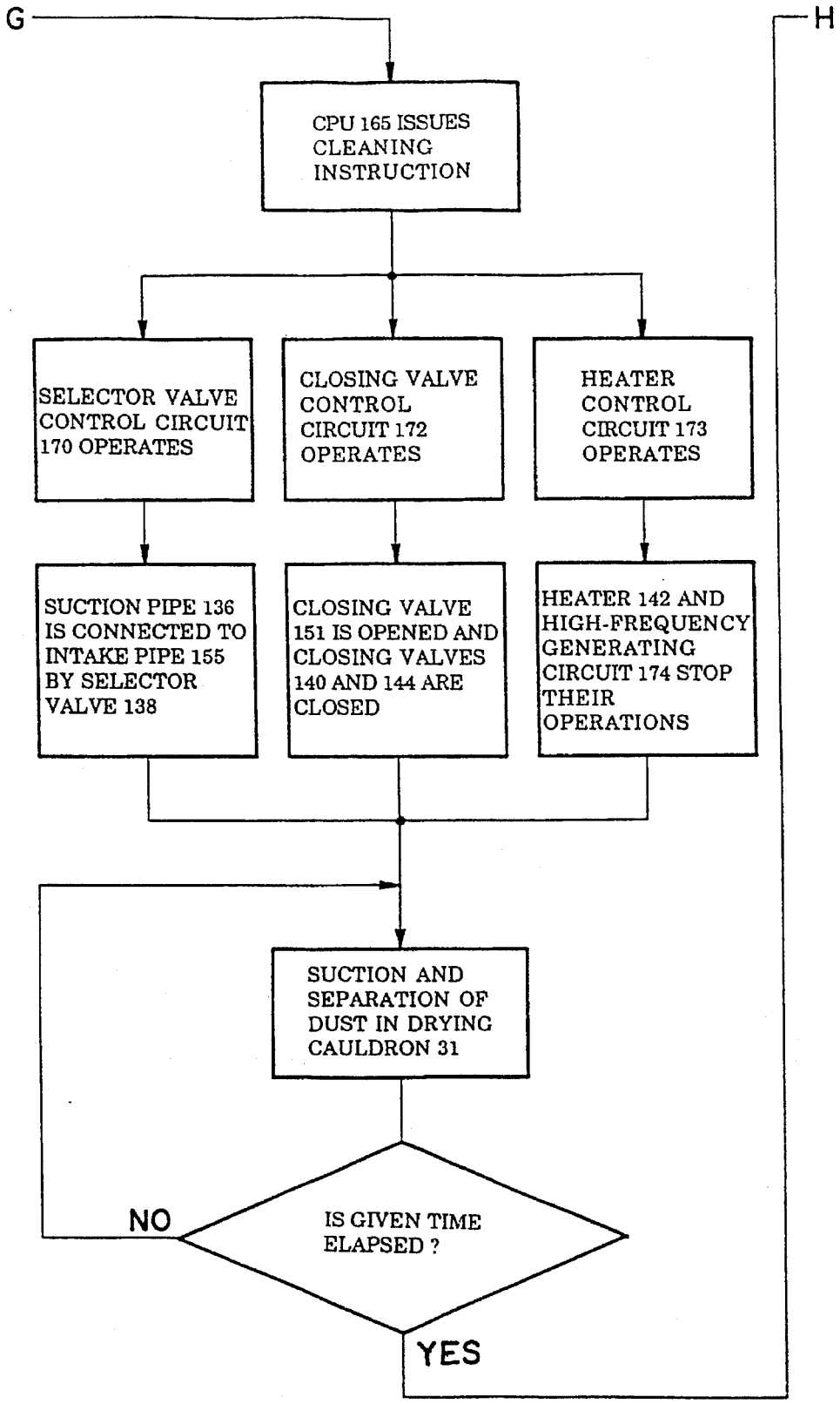
Figure 25:
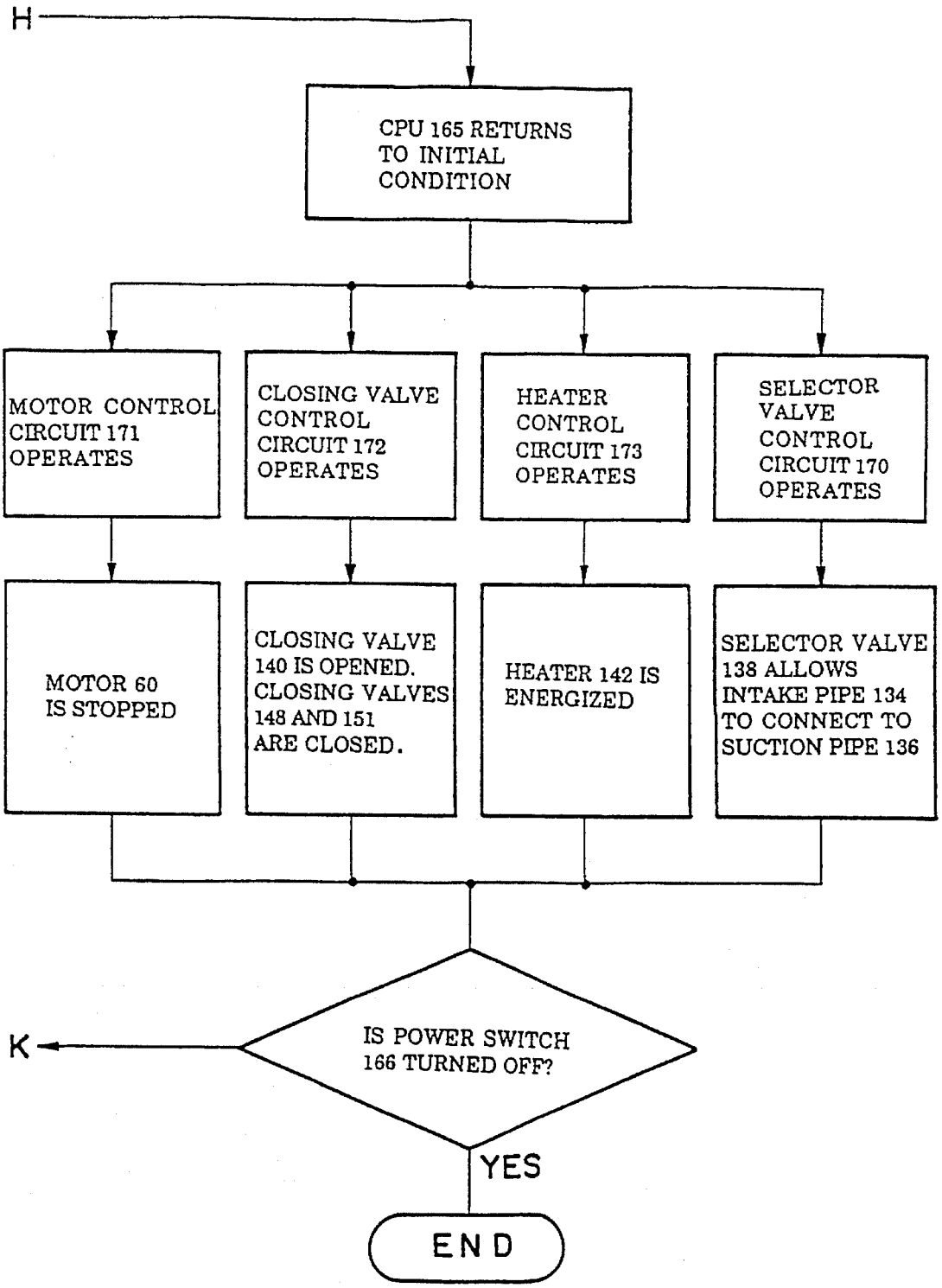

A series of operations of the disposal apparatus 15 are schematically shown in FIGS. 16 and 17. This flowchart shows main operations in the processing cycle so that one can understand the cycles starting from the turning of the power source to the turning off of the power sources.

FIG. 18 represents operating conditions of each mechanism in each processing condition in a series of operation cycles as a truth table.

FIGS. 19 to 25 are flowcharts showing processing cycles to be performed by the disposal apparatus 15. Accordingly, these processing cycles explain more in detail each mechanism to be operated in accordance with the processing cycles as shown in FIGS. 16 and 17.

Figure 26:
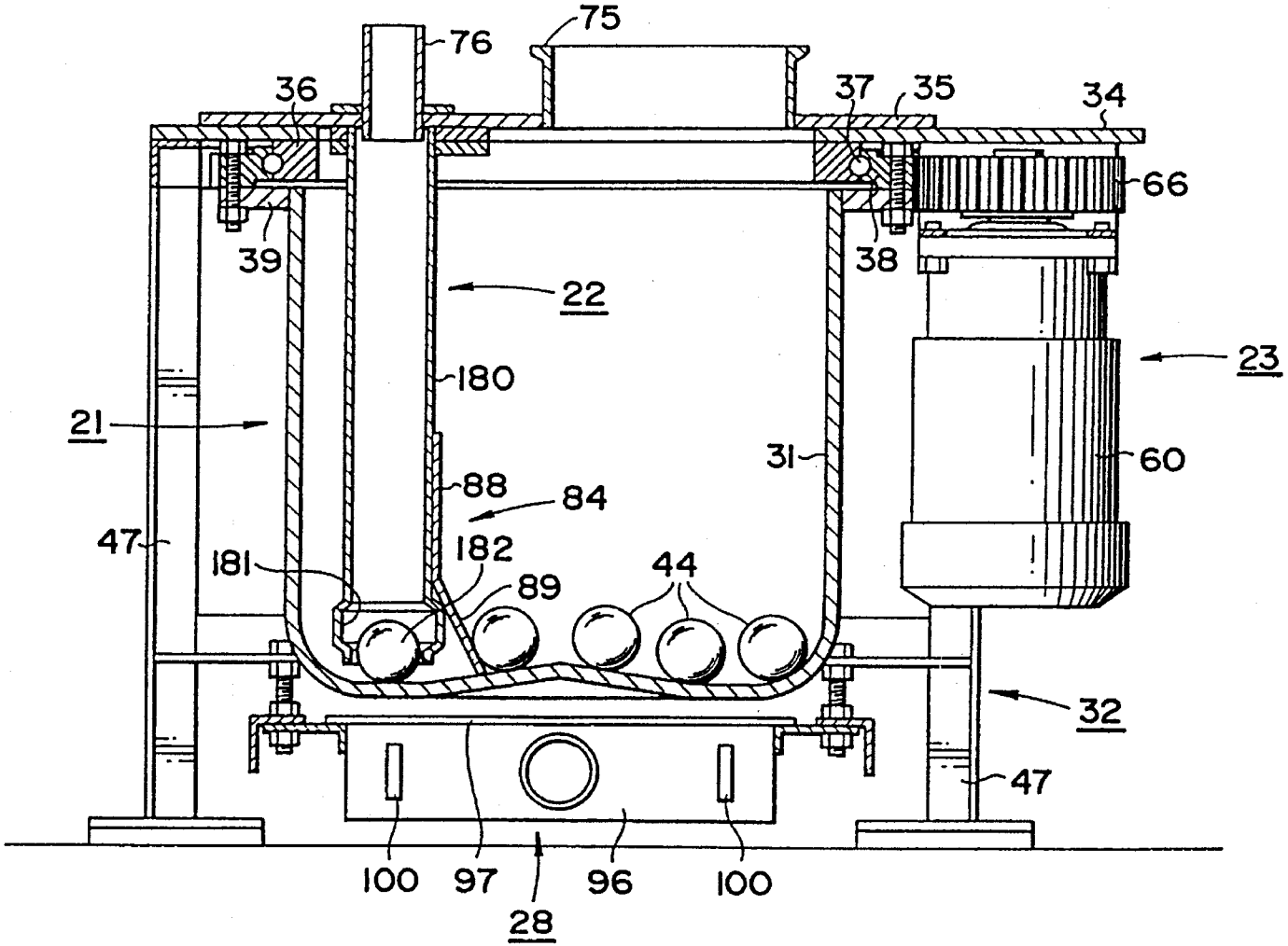
FIG. 26 is a longitudinal cross-sectional view which is cut together with a drying portion to show a dust suction portion of the raw sewage disposal apparatus according to a second embodiment of the invention.

Second Embodiment (FIG. 26):

In a second embodiment as illustrated in FIG. 26, the suction pipe 85 of the dust suction portion 22 in the first embodiment is improved. If the raw sewage in the drying cauldron 31 is evaporated, residual substances stick to the lower end opening of the suction pipe 85 in processing of the raw sewage for a long time, and they finally close this opening of the suction pipe 85. If the lower end opening of the suction pipe 85 is closed, the cleaning of the drying cauldron 31 caused by the suction of air will not be performed. In the second embodiment, such closing of the lower end opening of the suction pipe 85 is prevented, and hence the lower end opening of the suction pipe 85 can always be cleaned.

In the second embodiment, elements which are the same as those of the first embodiment are denoted by the same numerals and explanation thereof is omitted.

An upper end of a suction pipe 180 is fixed to the lower surface of the covering plate 35 under the air introduction pipe 76, wherein an axial line of the suction pipe 180 is set to be vertical. The suction pipe 180 has an upper end opening fixed to the lower surface of the covering plate 35 and a lower end opening positioned slightly over the bottom portion of the drying cauldron 31. That is, even if the drying cauldron 31 is rotated, the bottom portion of the drying cauldron 31 does not contact the suction pipe 180. The suction pipe 180 has a large diameter portion 181 which is positioned slightly above the lower end opening of the suction pipe 180 and is bulged a bit in its diameter. The suction pipe 180 accommodates therein a cleaning ball 182 with an outer diameter which is slightly smaller than an inner diameter thereof. The cleaning ball 182 contacts the inner periphery of the lower end opening when it contacts the bottom portion of the drying cauldron 31. Accordingly, even if the drying cauldron 31 is rotated, the cleaning ball 182 is merely rolled inside the suction pipe 180 and is restricted to not move outside the suction pipe 180.

With this arrangement of the second embodiment, if the raw sewage is introduced into the drying cauldron 31, and the drying and evaporating process are performed, the drying cauldron 31 is rotated by the motor 60. When the drying cauldron 31 is rotated, the cleaning ball 182 contacting the bottom portion of the drying cauldron 31 is also rotated only at a portion close to the lower end opening of the suction pipe 180. Accordingly, the cleaning ball 182 contacts the inner periphery of the lower end of the suction pipe 180 so that the residual substances of the dried raw sewage do not become stuck to the lower end opening of the suction pipe 180. The rotation of the cleaning ball 182 always follows the rotation of the drying cauldron 31 during the drying and evaporating process of the raw sewage, and it prevents the lower end opening of the suction pipe 180 from being stuck and clogged by the residual substances.

If the liquid component which is the primary component of the raw sewage contained in the drying cauldron 31 is evaporated, the cleaning process inside the drying cauldron 31 starts. In the cleaning process, air in the drying cauldron 31 is sucked by the air introduction pipe 76 through the suction pipe 180 so as to suck the dust and residual substances remaining in the drying cauldron 31. In such a manner, if the air is sucked by way of the suction pipe 180, the cleaning ball 182 is also sucked up at the same time.

However, since there is provided the large diameter portion 181 in the midway of the suction pipe 180, flow speed of the air drops at this large diameter portion 181, so that the air flows through a portion which is large in cross section and defined between the inner wall of the large diameter portion 181 and the outer periphery of the cleaning ball 182. Accordingly, the thus sucked cleaning ball 182 is lifted up to the large diameter portion 181 but it not lifted further. As a result, there is no possibility that the cleaning ball 182 is sucked up to the upper end of the suction pipe 180 to thereby close the suction pipe 180.

Figure 27:
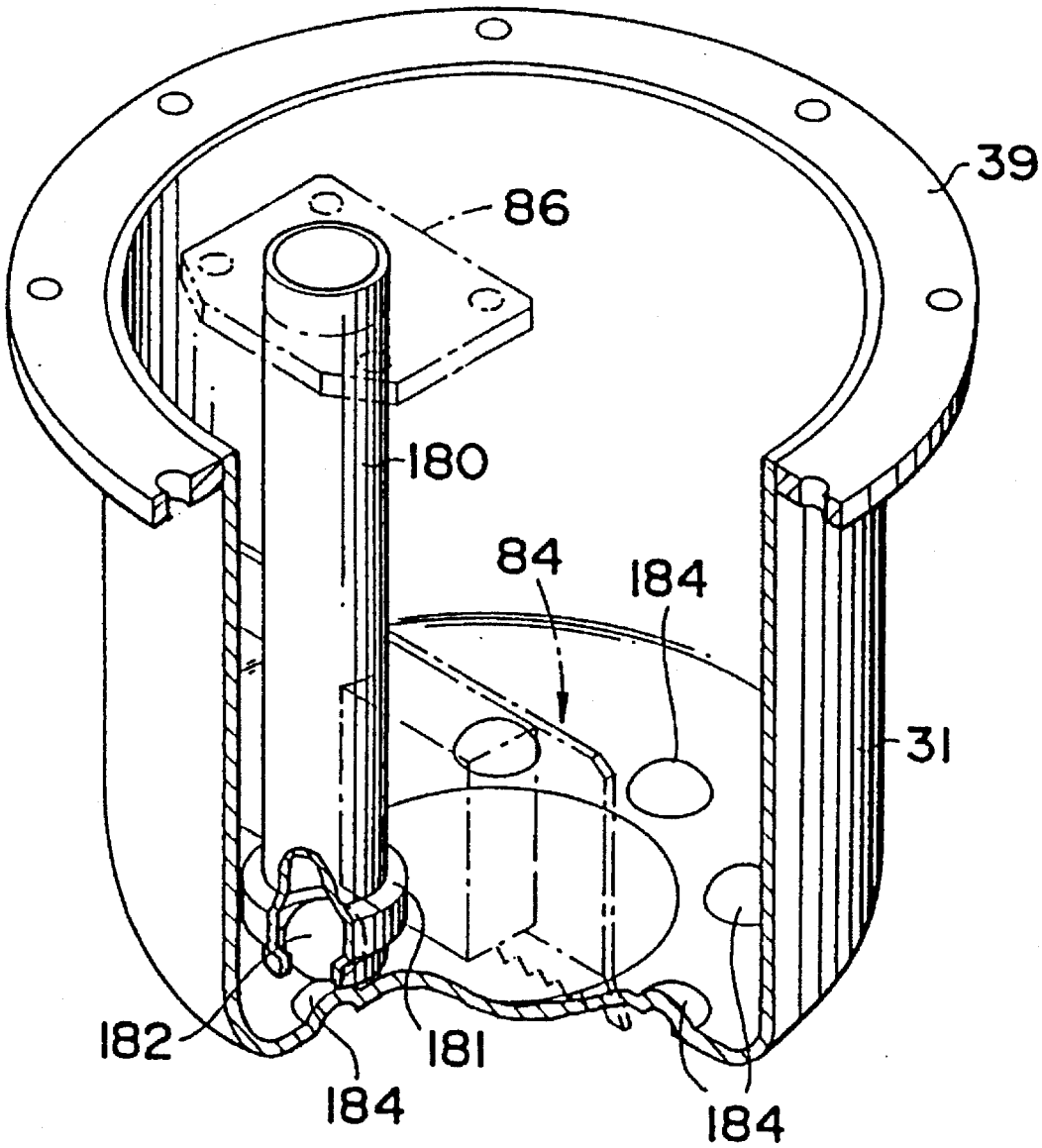
FIG. 27 is a longitudinal cross-sectional view in which a part of a drying cauldron is cut to show a dust suction portion of the raw sewage disposal apparatus according to a third embodiment of the invention.

Third Embodiment (FIG. 27):

FIG. 27 is a third embodiment of the present invention, in which the suction pipe 85 in the dust suction portion 22 of the second embodiment is further improved.

According to the third embodiment, shapes and structures of the suction pipe 180, the large diameter portion 181, and the cleaning ball 182 are the same as those of the second embodiment. However, vibrating projections 184, which are semicircular in an upward direction, are provided on the bottom surface of the drying cauldron 31 at a position (circular locus) where the lower end of the cleaning ball 182 contacts the bottom surface of the drying cauldron 31 when the drying cauldron 31 is rotated. These vibrating projections 184 are positioned on the circular locus formed by drawing a circle about the central axis of the bottom surface of the drying cauldron 31, and are disposed at equal intervals along the circular locus. These vibrating projections 184 are formed by drawing the metallic drying cauldron 31 from the rear surface thereof by a press process or by fixing a semicircular metallic piece to the bottom surface of the drying cauldron 31.

With the arrangement, when the raw sewage is introduced into the drying cauldron 31, and then subjected to the dry/evaporation process, the drying cauldron 31 is rotated by a rotary force of the motor 60. The vibrating projections 184 are rotated at the same time when the drying cauldron 31 is rotated so that they contact the lower end of the cleaning ball 182. Accordingly, the cleaning ball 182 is rotated when the drying cauldron 31 is rotated, and it is vertically vibrated when the cleaning ball 182 contacts the vibrating projections 184. Residual substances which stick to the lower end opening of the suction pipe 180 contacting the outer peripheral surface of the cleaning ball 182 can be cut off when the cleaning ball 182 is rotated and vertically vibrated. The residual substances can be surely cut off due to two directional motions of the cleaning ball 182.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A raw sewage disposal apparatus comprising:

a heat resistant metallic evaporation container having a closed bottom portion and an opened upper portion and defining therein a chamber for raw sewage;

a rotary holding means for holding an upper end of the evaporation container and for permitting horizontal rotation thereof;

a covering means having a lower surface for holding the rotary holding means and for closing off the opened upper portion of the evaporation container from the surrounding atmosphere;

a frame for hanging the evaporation container and supporting the covering means substantially horizontally;

a driving means for rotating the evaporation container; and an electromagnetic heating means disposed close to a lower surface of the evaporation container for generating a high-frequency electromagnetic wave therein and supplying the high-frequency electromagnetic wave to the evaporation container.

2. An apparatus according to claim 1, wherein:

at least one stirring means is contained in the evaporation container and has a spherical shape; and a movement restriction portion is fixed to the covering means and has a lower end extended to the bottom portion of the evaporation container so as to contact the stirring means.

3. An apparatus according to claim 2, wherein:

a dust suction portion is disposed vertically inside the evaporation container, the dust suction portion having an upper end fixed to the covering means and a lower end positioned close to the bottom portion of the evaporation container for sucking air so as to suck dust in the evaporation container.

4. An apparatus according to claim 1, wherein:

a dust suction portion is disposed vertically inside the evaporation container, the dust suction portion having an upper end fixed to the covering means and a lower end positioned close to the bottom portion of the evaporation container for sucking air so as to suck dust in the evaporation container.

5. An apparatus according to claim 3, wherein:

a dust separation portion is connected to a discharge side of the dust suction portion for separating dust from air; and an air blower portion having a suction side is connected to a discharge side of the dust separation portion.

6. An apparatus according to claim 1, wherein:

a stool is disposed above the covering means for communicating with the chamber of the evaporation container and for receiving the raw sewage; and a raw sewage introduction valve disposed under the stool and capable of closing an opened lower portion of the stool.

7. An apparatus according to claim 1, wherein the evaporation container is cylindrical at a peripheral surface thereof, and has an opened upper end and a closed substantially horizontal bottom portion, and wherein a center of the bottom portion rises like a ridge, and a central axial line of the peripheral surface extends vertically.

8. An apparatus according to claim 1, wherein the covering means comprises a horizontal plate-shaped covering plate positioned close to the opened upper end of the evaporation container.

9. An apparatus according to claim 1, wherein the rotary holding means comprises an annular fixed ring fixed adjacent the lower surface of the covering means and an annular rotary ring fixed to the opened upper end of the evaporation container, and wherein the rotary holding means is assembled by engaging the fixed ring with the rotary ring by means of a bearing therebetween.

10. An apparatus according to claim 1, wherein the driving means is fixed to the opened upper end of the evaporation container and comprises a rotary ring having a toothed circumferential surface, a small gear engaging with the tooth surface of the rotary ring, and a motor for rotating the small gear.

11. An apparatus according to claim 2, wherein the stirring means comprises spherical balls made of a metallic sintered ceramic material.

12. An apparatus according to claim 2, wherein the movement restriction portion comprises a flat-shaped baffle plate having a vertically positioned flat-surface, and a stirring plate connected to a lower side of the baffle plate so as to incline an upper surface thereof toward a center of the evaporation container.

13. An apparatus according to claim 3, wherein the movement restriction portion comprises a flat-shaped baffle plate having a vertically positioned flat-surface, and a stirring plate connected to a lower side of the baffle plate so as to incline an upper surface thereof toward a center of the evaporation container, and wherein a side surface of the baffle plate is fixed to a lower side surface of the dust suction portion having an upper end fixed to the lower surface of the covering means, the flat surface of the baffle plate is disposed perpendicularly to a straight line connecting the center of the evaporation container and the dust suction portion, and both side ends of the baffle plate are positioned close to an inner peripheral wall of the evaporation container.

14. An apparatus according to claim 4, wherein the dust suction portion comprises a pipe-shaped suction pipe accommodated vertically in the evaporation container, and wherein the suction pipe has an upper end fixed to the lower surface of the covering means and a lower end positioned slightly over the bottom portion of the evaporation container, and an opened upper end of the suction pipe communicates with an opening of the covering means.

15. An apparatus according to claim 4, wherein the dust suction portion comprises a pipe-shaped suction pipe accommodated vertically in the evaporation container, and has an upper end fixed to the lower surface of the covering means and a lower end positioned slightly apart from the bottom portion of the evaporation container, and a cleaning ball having a small diameter accommodated inside the suction pipe and capable of contacting the bottom portion of the evaporation container.

16. An apparatus according to claim 15, wherein spaced vibration projections are provided on the bottom portion of the evaporation container.

* * * * *